US012687026B2

(12) United States Patent
Hatzinikolas

(10) Patent No.: US 12,687,026 B2
(45) Date of Patent: Jul. 21, 2026

(54) CLOSURE APPARATUS FOR USE WITH SHELF ANGLES

(71) Applicant: Fero Corporation, Edmonton (CA)

(72) Inventor: Andrea Hatzinikolas, Edmonton (CA)

(73) Assignee: Fero Corporation, Edmonton (CA)

( * ) Notice: Subject to any disclaimer, the term of this patent is extended or adjusted under 35 U.S.C. 154(b) by 300 days.

(21) Appl. No.: 18/496,151

(22) Filed: Oct. 27, 2023

(65) Prior Publication Data

US 2025/0137263 A1 May 1, 2025

(51) Int. Cl.

| | |
|---|---|
| ***E04D 1/36*** | (2006.01) |
| ***E04F 13/08*** | (2006.01) |
| ***E04F 13/14*** | (2006.01) |
| ***E04F 19/02*** | (2006.01) |

(52) U.S. Cl.

CPC ..... *E04F 13/0805* (2013.01); *E04F 13/14* (2013.01); *E04F 19/02* (2013.01)

(58) Field of Classification Search

CPC ..... E04F 13/0805; E04F 13/14; E04F 19/02; E04F 13/0857

See application file for complete search history.

(56) References Cited

U.S. PATENT DOCUMENTS 4,373,314 A * 2/1983 Allan ..... E04B 1/7616 52/379
5,035,099 A * 7/1991 Lapish ..... E04F 13/0808 52/568
5,797,220 A * 8/1998 Zaccagni ..... E04D 13/064 52/11
5,881,502 A * 3/1999 Tamlyn ..... E04D 13/158 52/95
6,128,883 A * 10/2000 Hatzinikolas ..... E04B 1/4178 52/378
8,511,032 B2 * 8/2013 Abdel-Rahman ..... E04B 2/88 52/573.1
8,621,802 B2 * 1/2014 Spyrou ..... E04B 1/388 52/489.1
10,294,676 B2 * 5/2019 Hatzinikolas ..... F16M 13/02
10,323,419 B2 * 6/2019 Hatzinikolas ..... E04F 13/0857
11,674,316 B2 * 6/2023 Osmanski ..... E04F 13/14 52/506.06
11,773,599 B2 * 10/2023 Pursley, Jr. ..... E04B 2/08 52/506.05
2002/0152693 A1 * 10/2002 Krogstad ..... E04C 3/02 52/412
2025/0263933 A1 * 8/2025 Hatzinikolas ..... E04F 13/0805

* cited by examiner

*Primary Examiner* — Basil S Katcheves
(74) *Attorney, Agent, or Firm* — Smart & Biggar LP

(57) ABSTRACT

An assembly supports external masonry veneer. A soffit assembly is provided to close what might otherwise be an open eave lying inboard of the bottom margin of the masonry veneer. The soffit assembly includes a fitting that mounts to the toe of the shelf angle, such that the soffit may be mounted from the shelf angle and run rearwardly toward the supporting wall structure. The soffit assembly may come as a two-part assembly. Alternatively, it may come as a three-part assembly. In either circumstance the soffit assembly may include a drip edge. The soffit assembly includes an external coating.

15 Claims, 13 Drawing Sheets

CLOSURE APPARATUS FOR USE WITH SHELF ANGLES

FIELD OF INVENTION

This specification relates to structural materials for use in the construction of buildings, and, in one particular context, to support structure external veneer components.

BACKGROUND OF THE INVENTION

In former times, brick walls were load bearing structures. In contemporary building structures bricks, or other masonry elements, or other visible finished surface elements, are rarely load-bearing. They tend more often to be employed as surface cladding on the exterior face of load-bearing structure as a masonry veneer.

When mounting face brick or stone veneer on the face of a wall structure, the first row of bricks or stone, or veneer commonly fits on a steel support. The steel support may be termed a shelf angle, and may extend outward from the wall structure, and may run along, or have a major dimension extending in, a direction that is generally horizontal and cross-wise to the wall. The steel support is mounted to the wall before brick-laying commences. The steel support may be welded to a steel anchoring system embedded in the wall. Alternatively, the steel support may be carried in spaced apart brackets that have themselves been mounted to the load bearing wall structure. This becomes more problematic where the wall is not planar, but curved or rectangular, and where the wall is interrupted by interruptions and boundary conditions such as corners, doors, windows, and so on.

SUMMARY OF INVENTION

In an aspect of the invention there is a shelf angle. It has a web and a flange extending away from the web.

A masonry veneer support assembly that has a masonry veneer shelf angle, a first mounting bracket, and a second mounting bracket. The first and second mounting brackets attach to building structure. The shelf angle has a first leg that extends upwardly, and a second leg that extends forwardly away from the building structure. The masonry veneer shelf angle seats on the first and second mounting brackets. A soffit is mounted to the shelf angle. The soffit extends rearwardly toward the building structure.

In a feature of that aspect of the invention, the assembly includes a further securement mounted to the building structure, and the soffit has an outboard margin mounted to the shelf angle and an inboard margin mounted to the further securement. In another feature, the further securement has a folded strip that defines a slot. The soffit has an inboard margin that, on installation, slides into the slot. In another feature, the further securement is a J-strip. In yet another feature, the second leg of the shelf angle has a tip most distant from the building structure and the soffit has an outboard flange folded to conceal the outboard tip. In a further additional feature, the flange of the soffit has a return leg that extends rearwardly toward the building structure; and, as installed, masonry veneer seated above the second leg of the shelf angle overlaps at least a portion of the return leg. In yet another feature, the assembly has a flashing drip edge that overhangs the soffit. In a still further feature, the soffit has an epoxy coating. In yet another feature, both the soffit and the further securement have an external coating. In still yet another feature, the horizontal leg of the shelf angle has a toe, and the outboard margin of the soffit has an accommodation sized to admit the toe of the shelf angle; and the assembly includes a support rail that mounts to a wall of structure, the support rail has a slot, and the soffit has an inboard margin that seat in the slot of the rail.

In another aspect, there is a soffit assembly that has a first rail fitting that mounts to an inner wall; a second rail fitting having a first engagement interface and a second engagement interface; and a soffit that extends between, and is mounted to, the first rail fitting and the second rail fitting. The first engagement interface is mounted to a masonry veneer shelf angle. The second engagement interface has an accommodation in which to admit a margin of the soffit.

In a feature of that aspect the first engagement fitting forms an interference fit with a toe of the masonry veneer shelf angle. In another feature the first engagement fitting of the second rail fitting defines a socket in which to receive a toe of a shelf angle, and the second engagement fitting defining a first slot in which a first margin of the soffit is admitted on assembly. In another feature the first rail fitting defines a second slot in which a second margin of the soffit is admitted on assembly. In still another feature, the second rail fitting has a drip edge.

BRIEF DESCRIPTION OF THE ILLUSTRATIONS

The foregoing aspects and features of the invention may be understood with the aid of the accompanying illustrations, in which.

Figure 2:
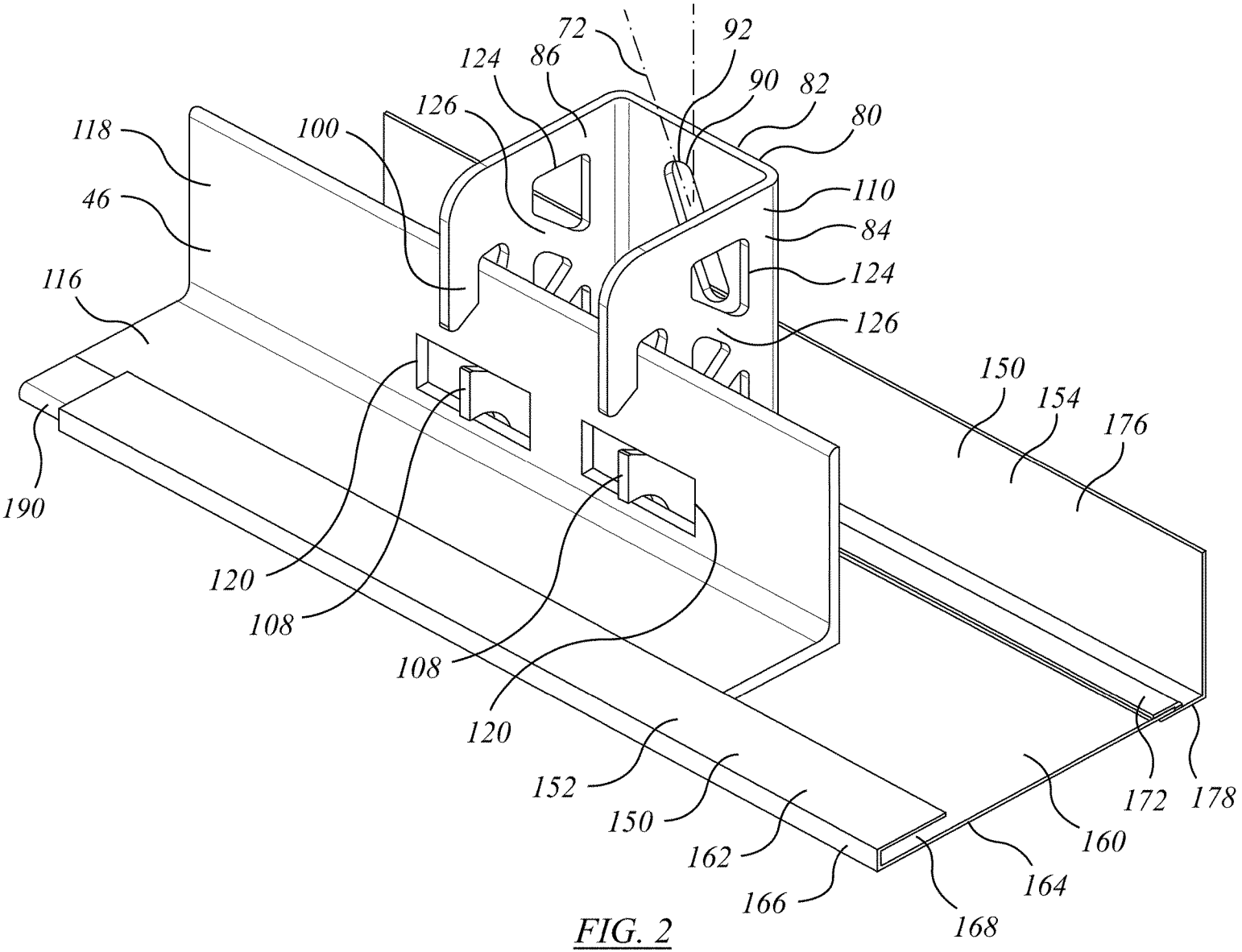
FIG. 2 is a perspective view from above of the masonry veneer support installation if FIG. 1.
Figure 3:
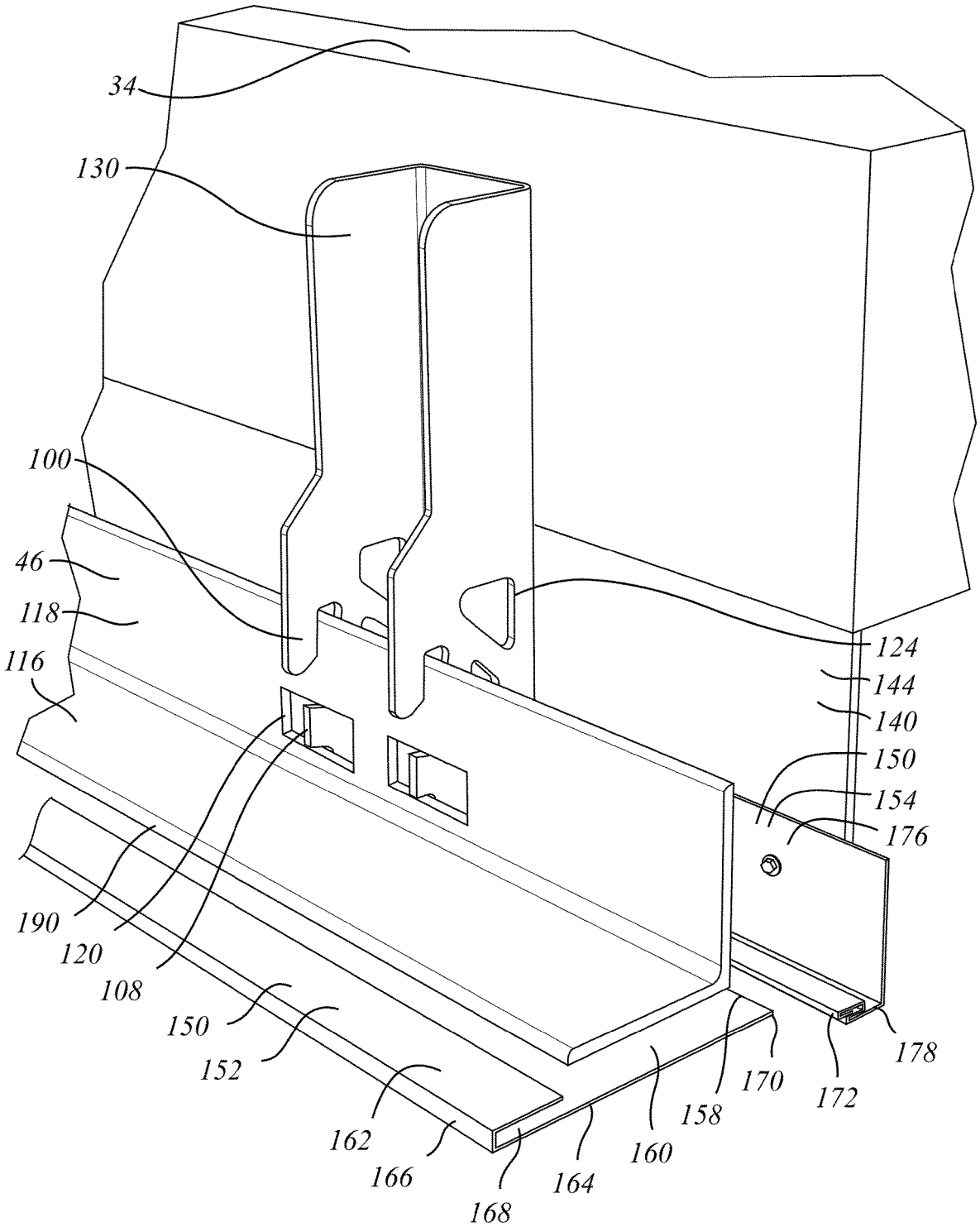
FIG. 3 is a perspective view from above of a long-legged alternate masonry veneer support installation to that of FIG. 2.
Figure 4A:
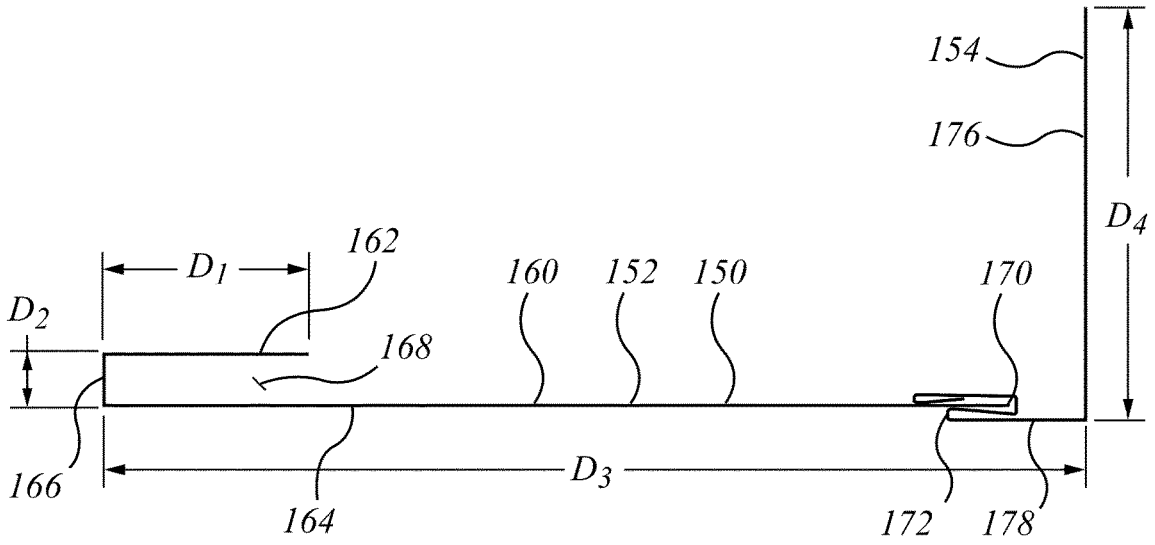
Figure 4B:
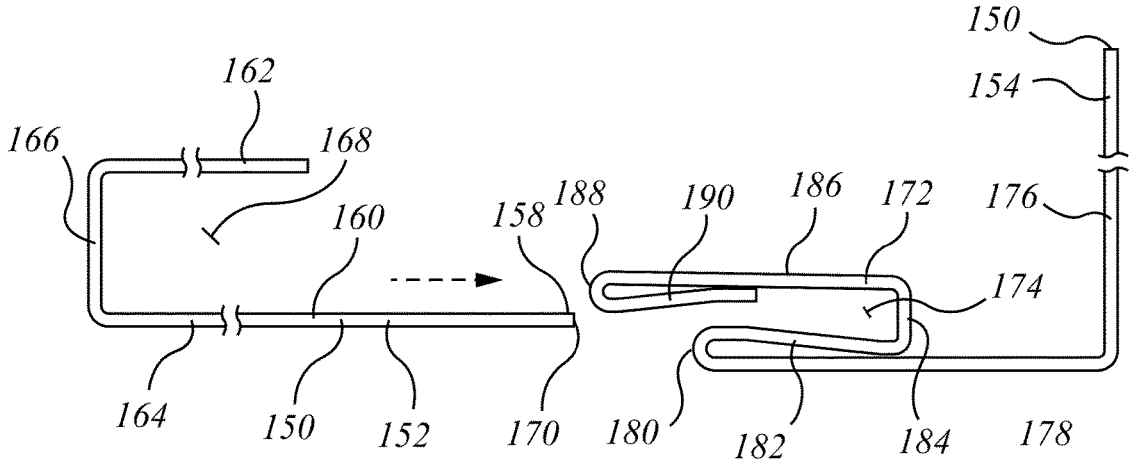

FIG. 4*a* is a side view of a detail of the masonry veneer support assembly of either FIG. 2 or FIG. 3;

FIG. 4*b* is an enlarged detail of FIG. 4*a*; and

Figure 4C:
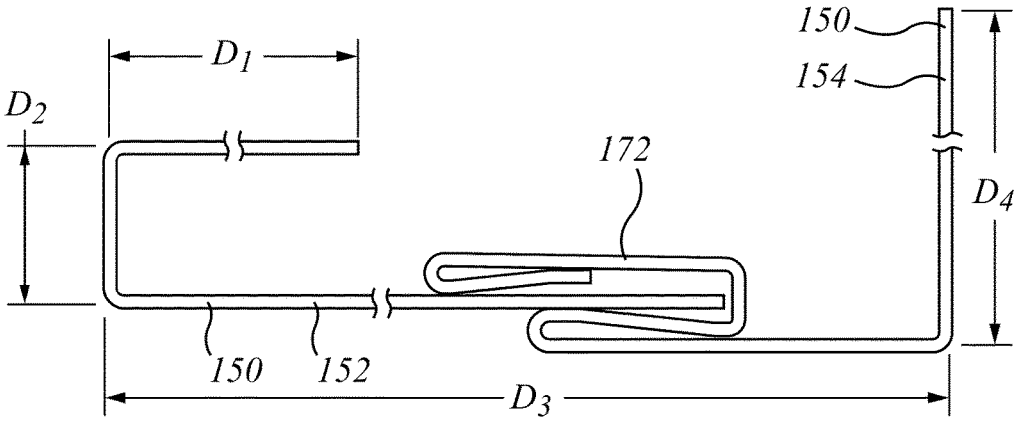
Figure 5A:
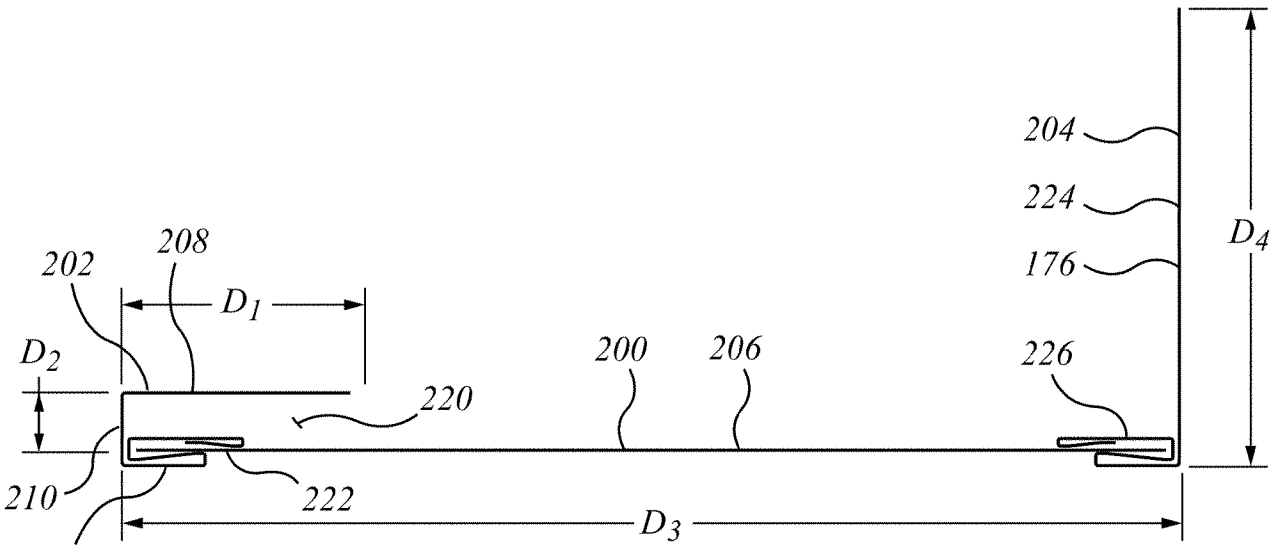

FIG. 4*c* is an enlarged detail of the assembly of FIG. 4*b* prior to assembly;

FIG. 5*a* is a side view of an alternate assembly to that of FIG. 4*a;*

Figure 5B:
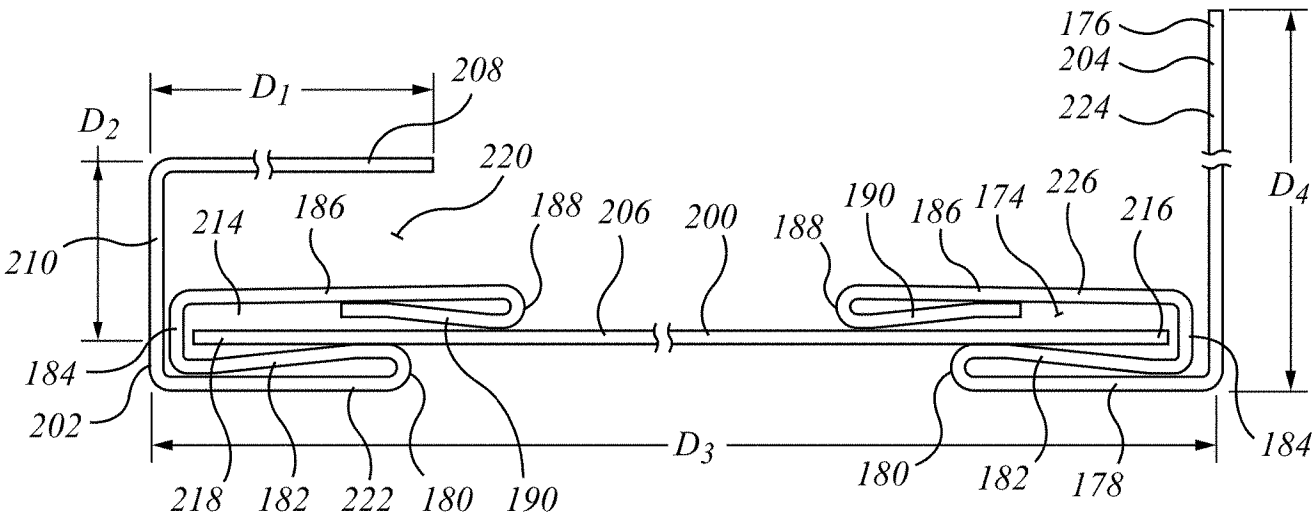

FIG. 5*b* is an enlarged foreshortened view of the assembly of FIG. 4*b;*

Figure 6A:
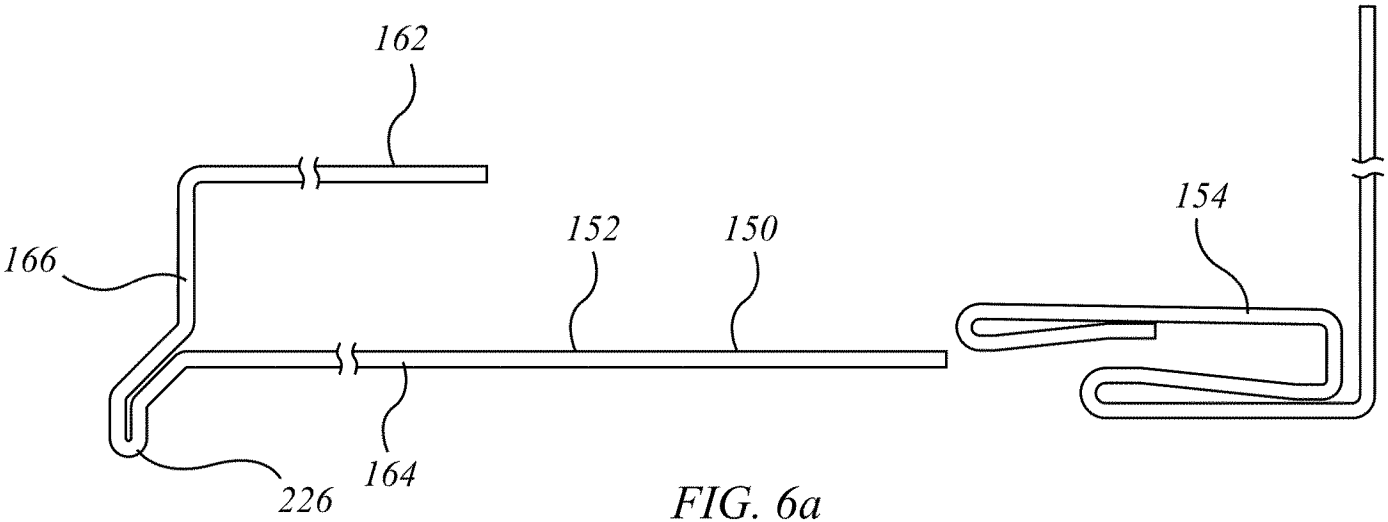

FIG. 6*a* is an alternate embodiment of the assembly of FIG. 4*b;*

Figure 6B:
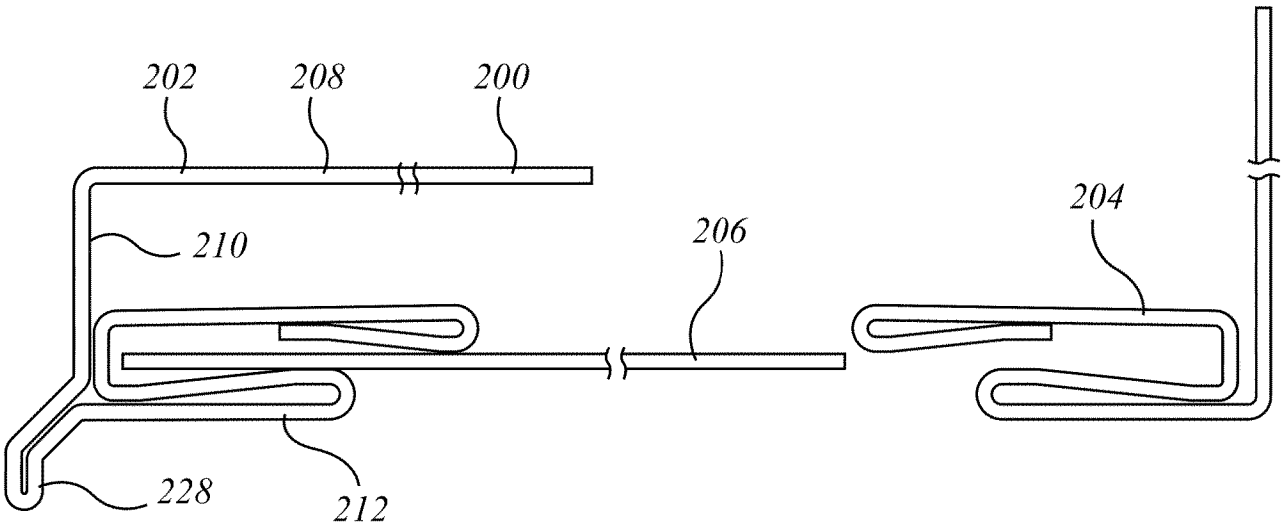

FIG. 6*b* is an alternate embodiment of the assembly of FIG. 5*b;*

Figure 1:
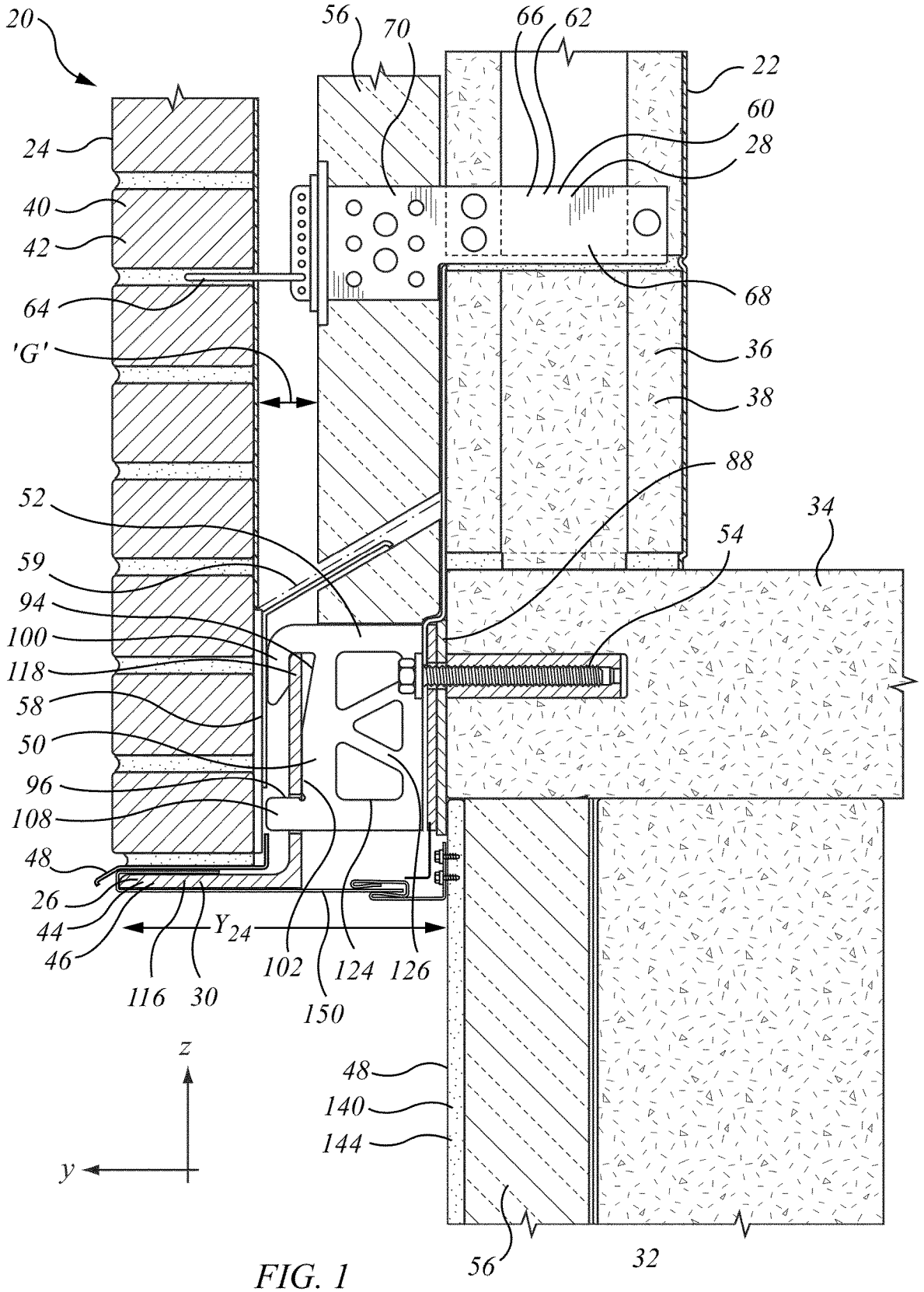
FIG. 1 is a side view of a masonry veneer support installation.
Figure 7A:
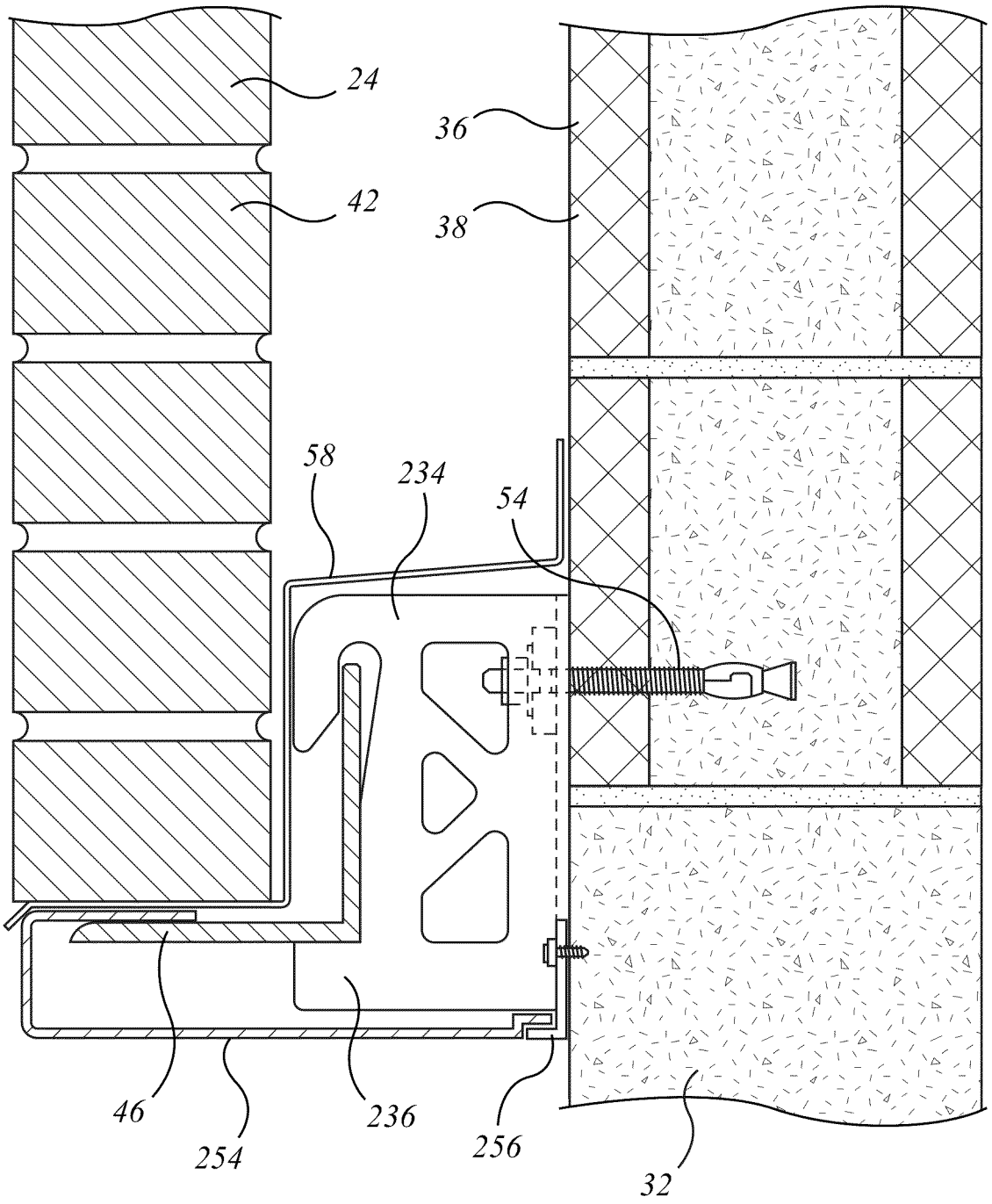
Figure 7B:
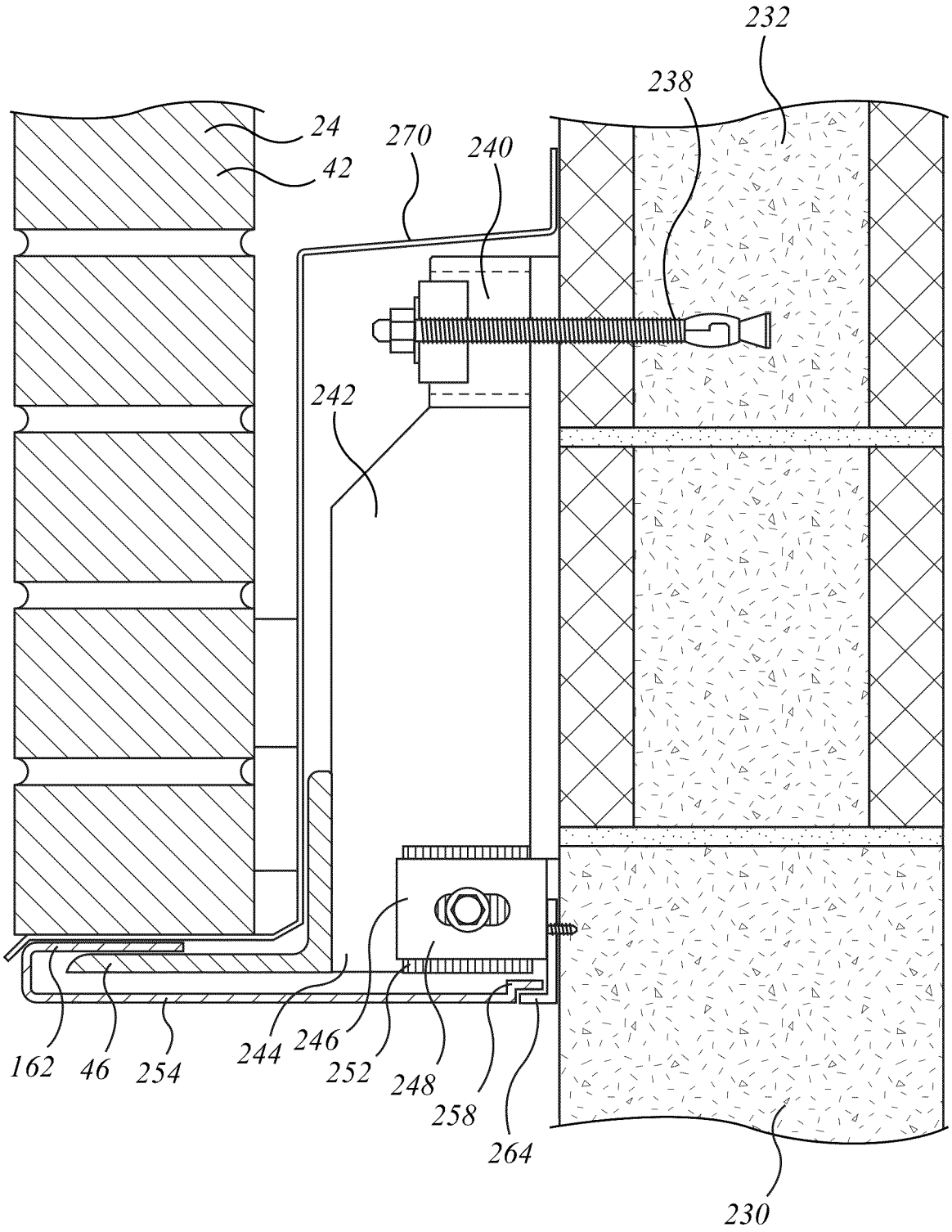

FIG. 7*a* is an alternate embodiment to that of FIG. 1;

FIG. 7*b* is an alternate embodiment to that of FIG. 1 or FIG. 7*a;*

Figure 8A:
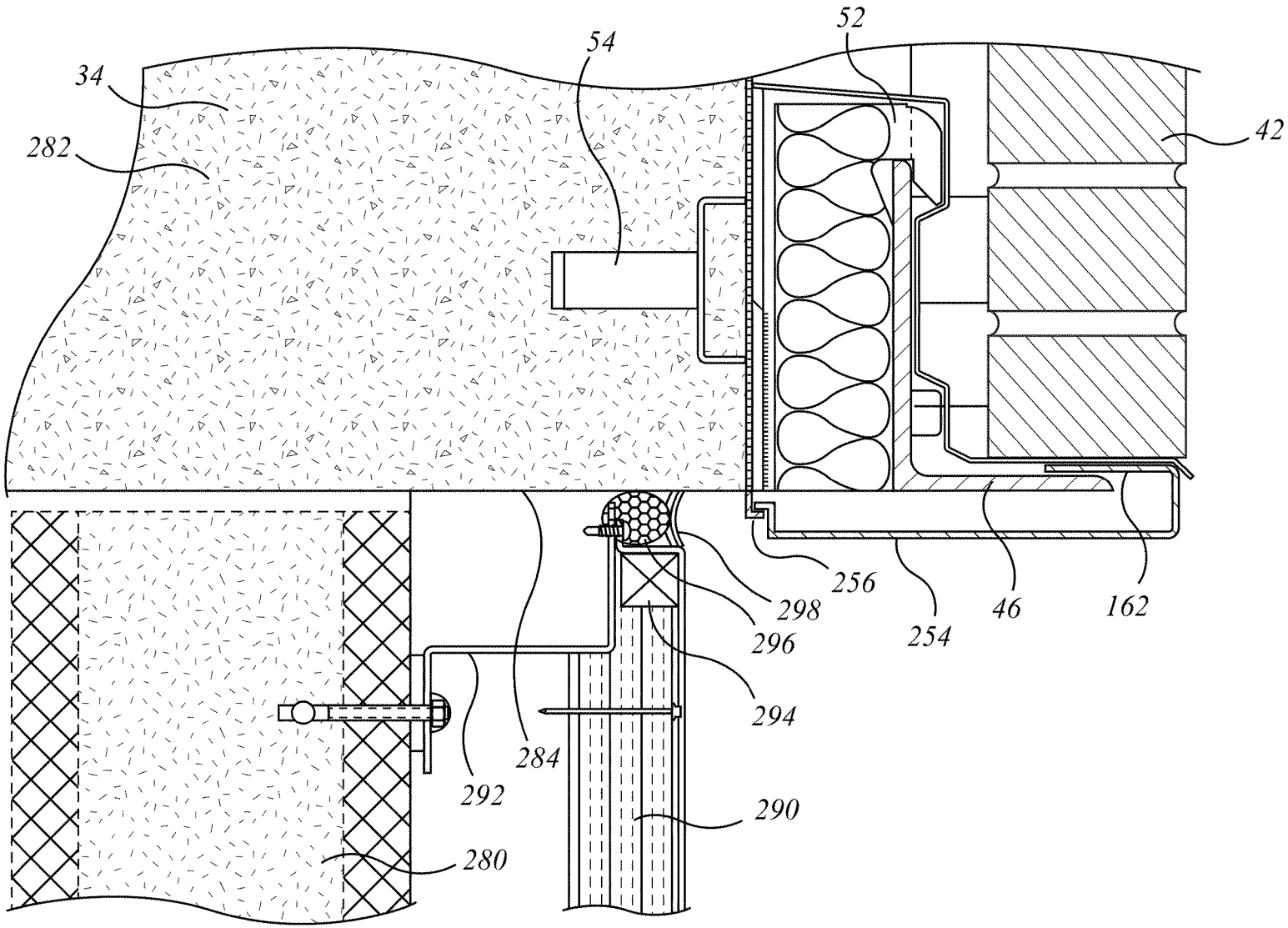
Figure 8B:
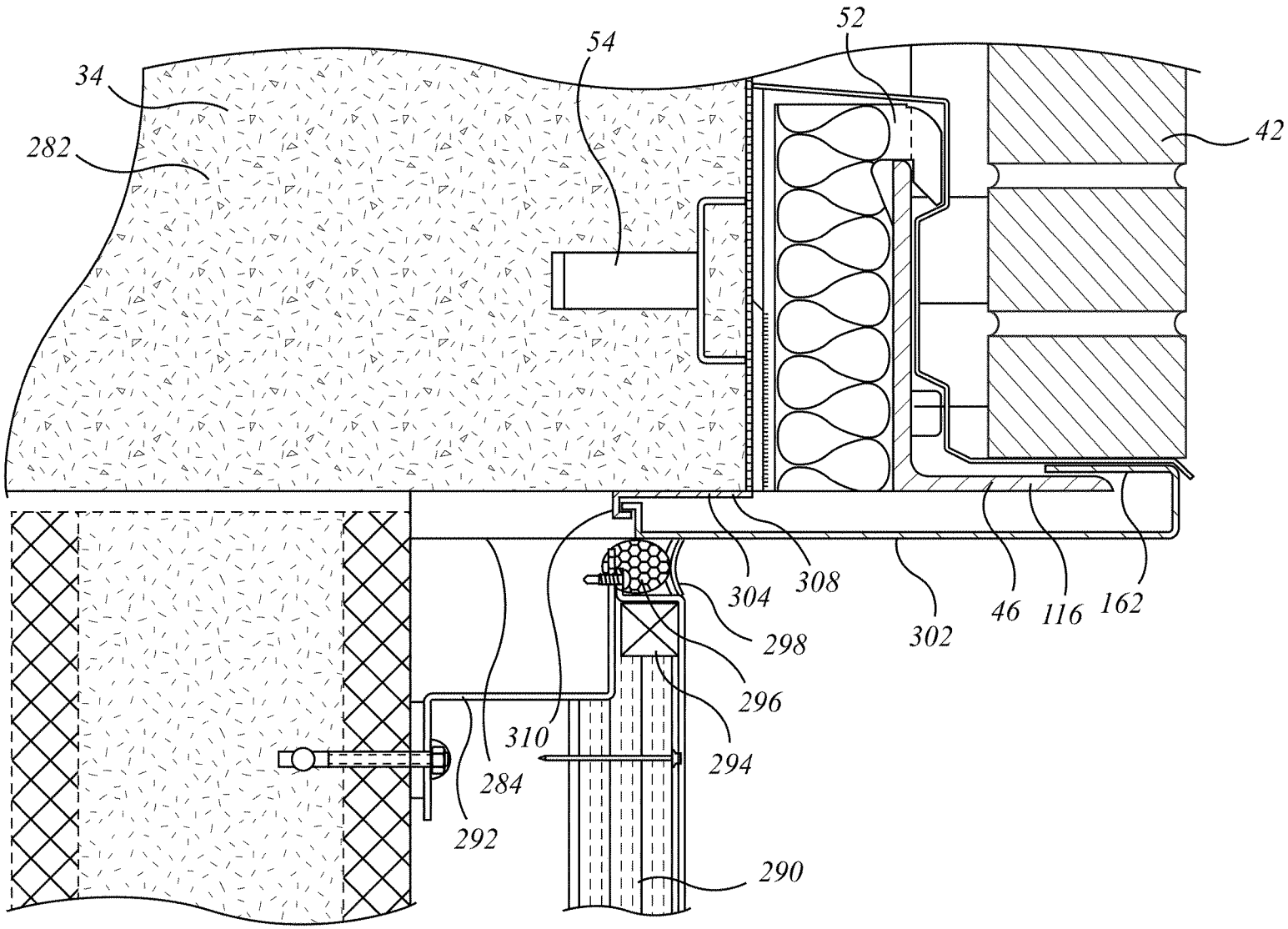

FIG. 8*a* is a further alternate embodiment to that of FIG. 1;

FIG. 8*b* is a further alternate embodiment to that of FIG. 8*a;*

Figure 9A:
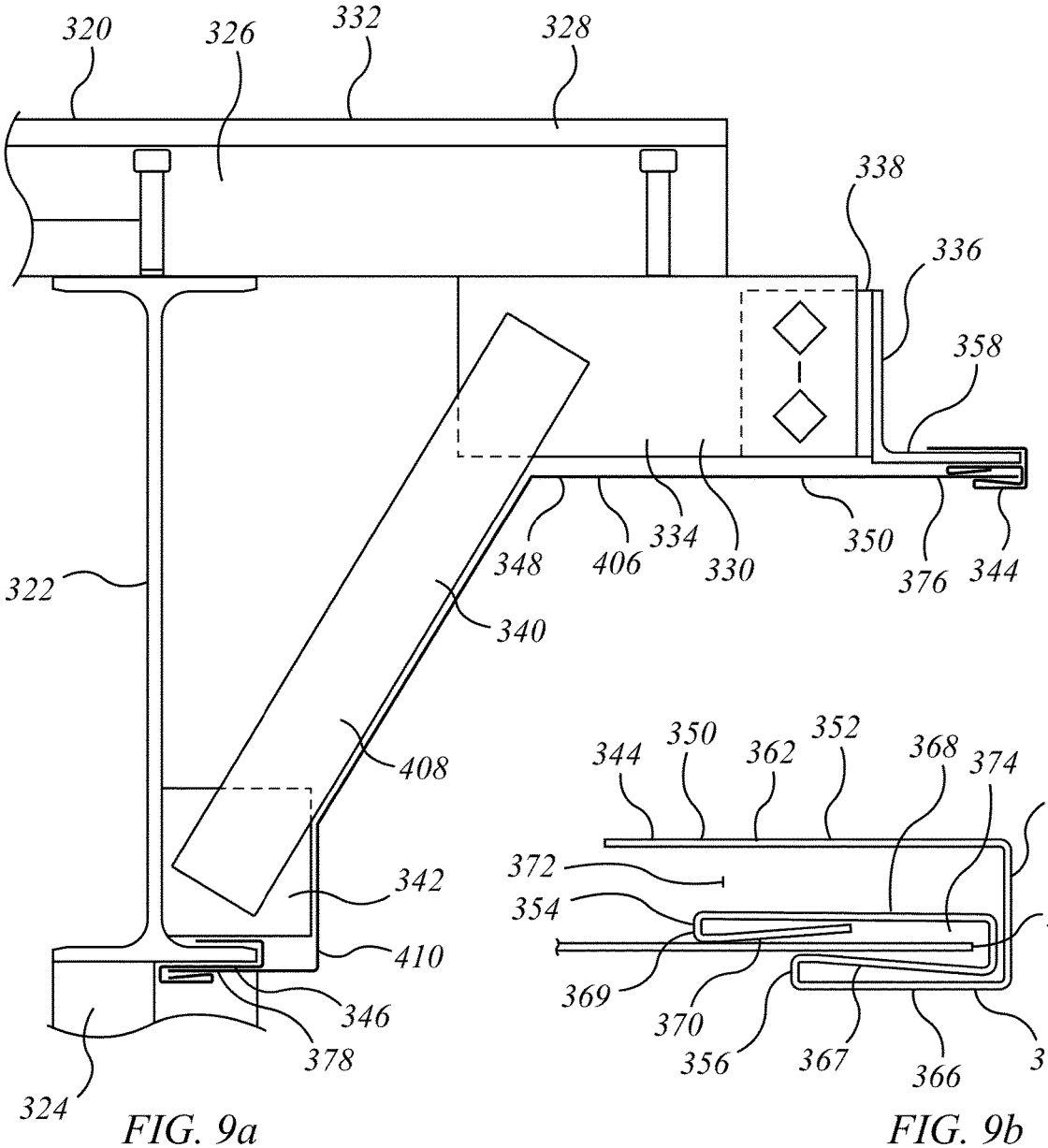
Figure 9B:
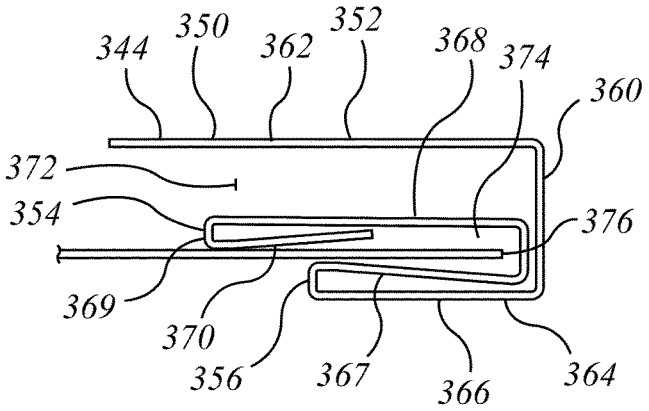

FIG. 9*a* is a further alternate embodiment to that of FIG. 1;

FIG. 9*b* is an enlarged detail of the embodiment of FIG. 9*a;*

Figure 9C:
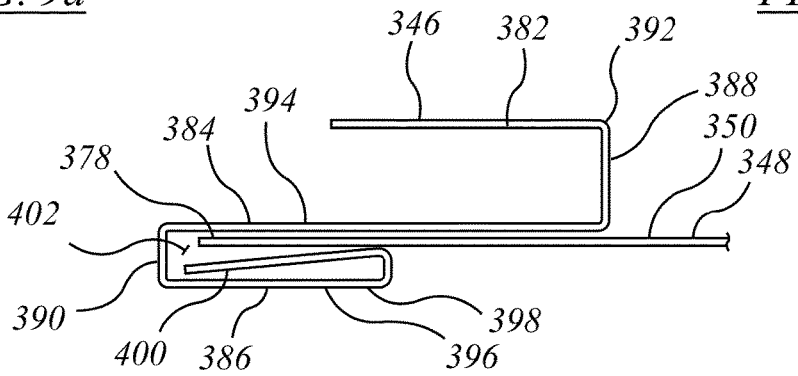

FIG. 9*c* is another enlarged detail of the embodiment of FIG. 9*a;*

Figure 9D:
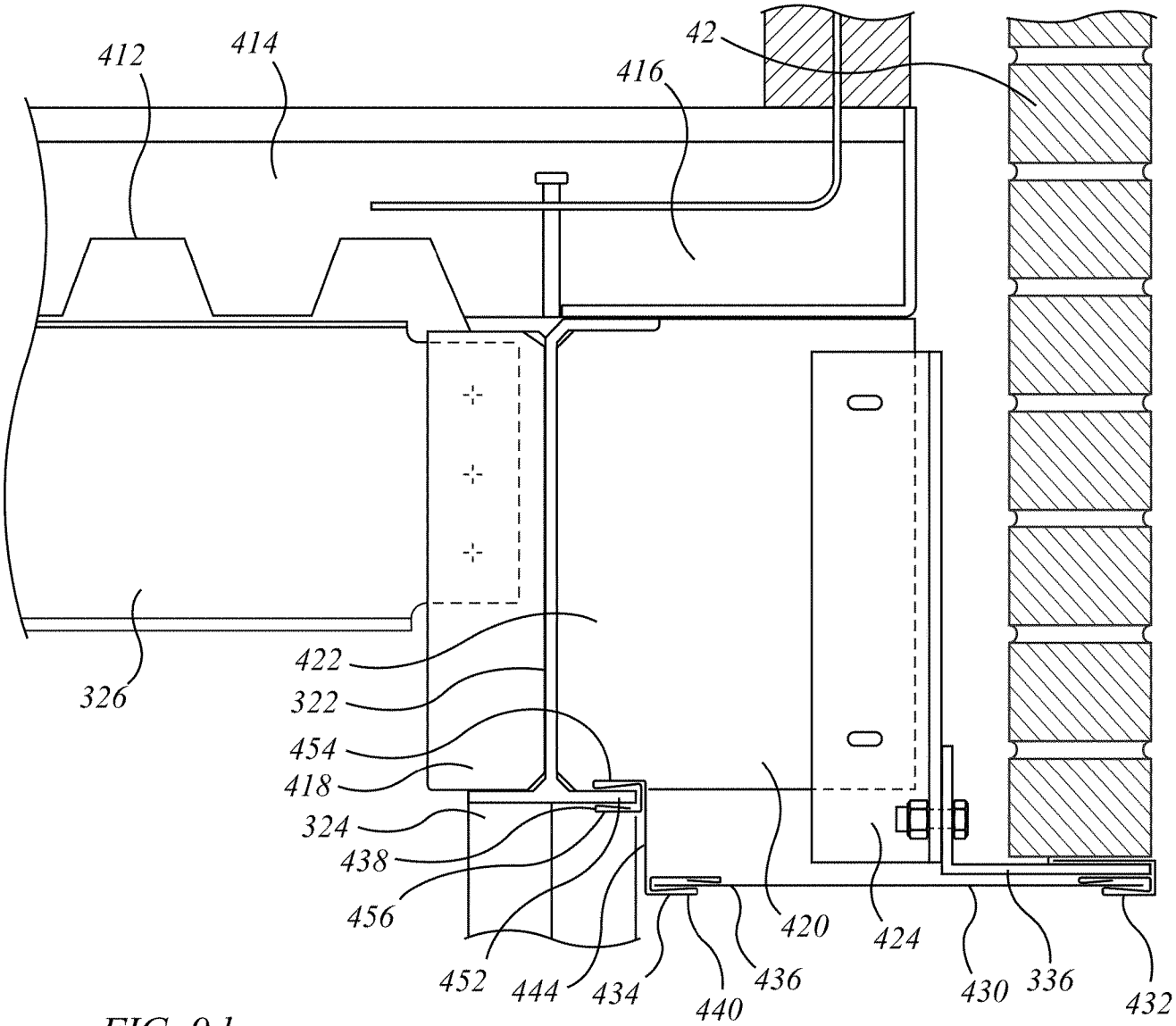

FIG. 9*d* is a further alternate embodiment to that of FIG. 9*a;*

Figure 9F:
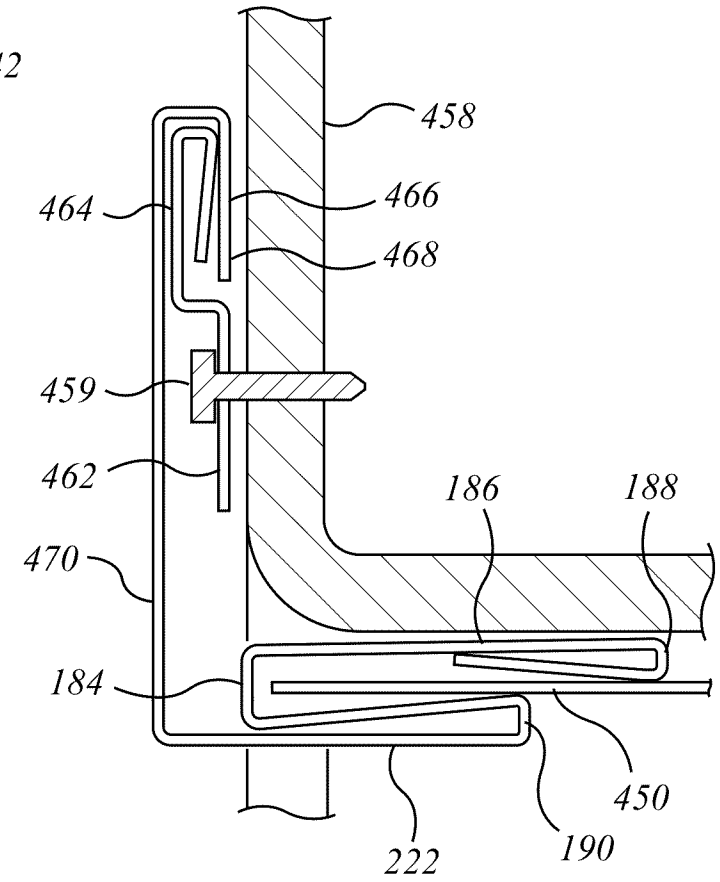
Figure 9E:
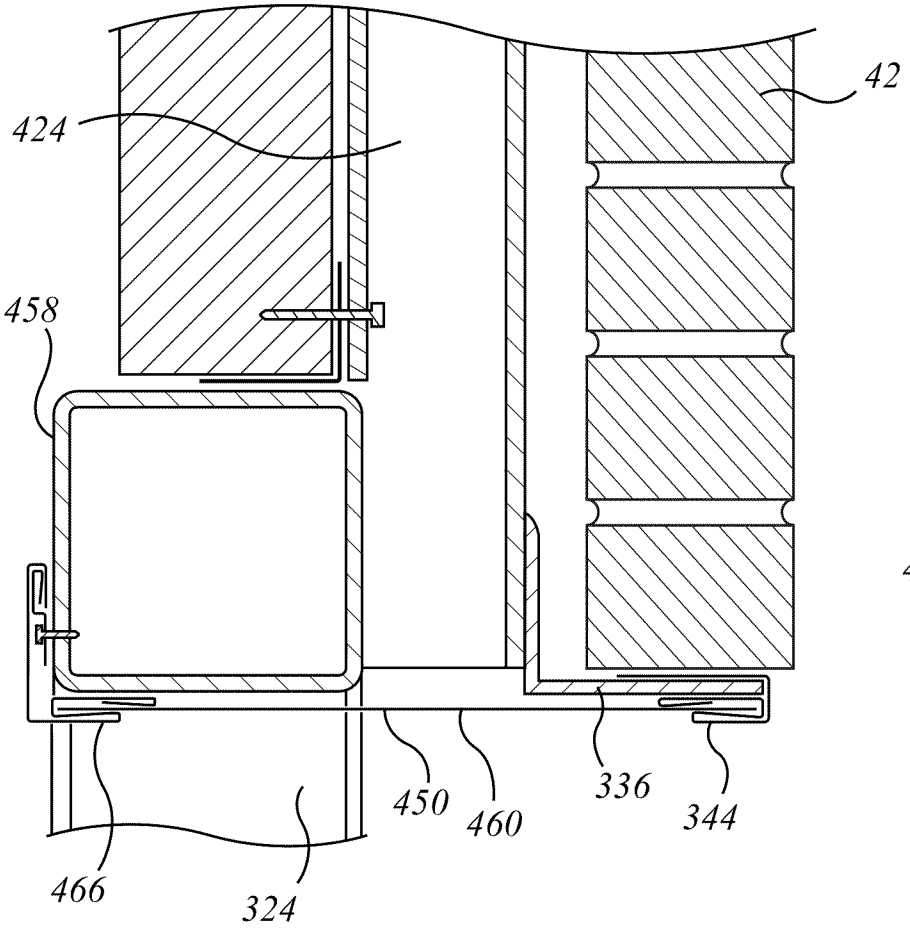

FIG. 9*e* is a further alternate embodiment to that of FIG. 9*a*; and

FIG. 9*f* is an enlarged detail of the embodiment of FIG. 9*e*.

DETAILED DESCRIPTION

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings may be taken as being to scale, or generally proportionate, unless indicated otherwise.

The terminology used in this specification is thought to be consistent with the customary and ordinary meanings of those terms as they would be understood by a person of ordinary skill in the art in North America. Following from the decision of the Court of Appeal for the Federal Circuit in *Phillips* v. *AWH Corp*., the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of experience in the art.

Referring to the general arrangement of FIG. 1, and the side view of FIG. 2, there is a partial cross-section of a wall assembly, indicated generally as 20, such as might include the shelf angle assembly 30. For the purposes of this description it may be helpful to consider a Cartesian coordinate frame of reference. The vertical, or up-and-down, direction may be designated as the z-axis, or z-direction. The direction perpendicular to the plane of the page may be considered as the longitudinal direction or x-direction, or x-axis, and may be taken as being the cross-wise direction of the wall. The left-to-right direction in the plane of the page, i.e., perpendicular to the wall, may be considered the sideways, or y-direction, or y-axis.

In this description, reference is made to building structure, or load-bearing structure, and load-bearing wall structure. The description pertains to mounting bracket assemblies that support external facing veneer components, such as face brick, spaced away from the supporting structure. The mounting brackets are anchored to load-bearing structure. Whether that load bearing structure is a structural wall or a concrete floor slab carried by framework, by a poured wall, by a block wall, or other load bearing members, in the context of this description whether it is a wall, a floor, or a ceiling, within the meaning of this specification it is a load-bearing wall structure to which the veneer supporting members may be mounted.

This description relates to apparatus, such as shelf angle assembly 30, for supporting masonry veneer, such as face brick or face stone, whether rough or finished. The masonry veneer may be taken as having a weight of 35 lbs/sq. ft. The various alternatives herein include a first member (or several first members), and a second member. The first member, or members, may be wall mounting brackets. The second member may be a shelf angle. The term "shelf angle" is a term of art in the science of building construction. See, for example "Technical Notes on Brick Construction" by the Brick Industry Association, 1850 Centennial Park Drive, Reston, Virginia, 20191, www.gobrick.com (703) 620-0010, identified as 28B and dated December 2005, found at https://www.gobrick.com/docs/default-source/read-research-documents/technicalnotes/28b-brick-veneer-steel-stud-walls.pdf?sfvrsn=. A "shelf angle" is a substantial structural member, capable of carrying the 35 lbs/sq. ft. load of a masonry veneer, and is not to be confused with light metal railings for kitchen shelves, book shelves, or display cabinets in a retail display. A shelf angle has a forwardly extending leg that has a length, or reach, that exceeds the depth of face brick. Such a length may be 4 to 6 inches, or possibly more. Unless otherwise stated, as a default herein, the first member and second member may be as being steel, which may be a mild steel. Other materials may be suitable depending on the circumstances. A shelf angle may be a rolled steel member, rolled at the steel mill, having a back, or web, square to the horizontal flange, or shelf, upon which the masonry veneer sits. It is usually hot rolled steel. It has a material thickness that is generally ¼" or more, such as or 5⁄16", ⅜" or 7⁄16" or ½", with various lineal weights per foot. A shelf angle is not something in which the horizontal leg can be bent by hand to change the angle relative to the back: it is a rigid, rolled steel section. Shelf angles are shown and described in at least U.S. Pat. No. 6,128,883 issued on Oct. 10, 2000; U.S. Ser. No. 14/556,824 filed Dec. 1, 2014, issued as U.S. Pat. No. 9,316,004 on Apr. 19, 2016; U.S. Ser. No. 14/556,947 filed Dec. 1, 2014, issued as U.S. Pat. No. 9,447,585 on Sep. 20, 2016; U.S. Ser. No. 14/688,477 filed Apr. 16, 2015 issued as U.S. Pat. No. 10,323,419 on Jun. 18, 2019; U.S. Ser. No. 15/075,682 filed Mar. 21, 2016 issued as U.S. Pat. No. 10,294,676 on May 21, 2019; U.S. Ser. No. 15/626,474 filed Jun. 19, 2017, issued as U.S. Pat. No. 11,078,672 on Aug. 3, 2021; U.S. Ser. No. 16/137,177 filed Sep. 20, 2018, issued as U.S. Pat. No. 11,041,315 on Jun. 22, 2021; U.S. Ser. No. 16/426,801 filed May 30, 2019, issued as U.S. Pat. No. 11,118,358 on Sep. 14, 2021; U.S. Ser. No. 16/700,868 filed Dec. 2, 2019, issued as U.S. Pat. No. 11,255,091 on Feb. 22, 2022; U.S. Ser. No. 16/841,611 filed Apr. 6, 2020, issued as U.S. Pat. No. 11,162,265 on Nov. 2, 2021 and U.S. Ser. No. 17/332,667 filed May 27, 2022, issued Mar. 29, 2023 as U.S. Pat. No. 11,629,504.

Shelf angles are not light steel, aluminum or plastic sections. Examples of apparatus that are not shelf angles are shown in WO 99/21669 of Ferrante et al.; US 2006/0 010 789 of Andino; US 2006/0 277 840 of Bailey; US 2007/0 151 190 of Huff; WO 02/06603 of Guerrasio; U.S. Pat. No. 6,094,877 of White; US 2009/060 656 of Szkola; U.S. Pat. No. 5,212,917 of Kurtz. This listing is not thought to be exhaustive. None of these references show, describe, or suggest shelf angles. Items provided for forming the edges of gardens, or as a border for driveway interlocking paving stones, or trimming dry-wall have no relationship to substantial structural elements that carry masonry loads on a cantilevered leg of an angle section. By definition, they are not shelf angles, and cannot reasonably be interpreted as shelf angles.

Shelf angles are sometimes made in 20 ft or 40 ft lengths, cut to length, and, in some instances, may have mounting apertures or other fittings in the back as described hereinbelow, or machined, cut, or punched to yield the segmented form described in greater detail herein. Likewise, shelf angle mounting brackets are substantial structural elements of sizes, thicknesses and weights commensurate with the role of supporting shelf angles and the masonry veneer they carry.

Wall assembly 20 may include load-bearing structure, or a load bearing assembly, indicated generally as 22, and externally visible facing elements, indicated generally as 24. The externally visible facing elements are mated to, or linked to, or stabilized by, load bearing structure 22. The linking, or positioning of the facing elements with the load-bearing structural elements may be achieved by the use of interface elements such as supports, or support assemblies, 26, and tying members 28. Support assemblies 26 and tying members 28 may be taken as being made of mild steel unless otherwise noted. Combinations of load bearing frame or wall assemblies, such as 22, facing elements 24, support assemblies 26 and tying assemblies 28 may be assembled as indicated in FIG. 2*a*.

Load-bearing structure 22 can be understood as being a supporting primary structure, which may have several different forms. First, it may include a foundation, which may be a poured concrete foundation 32. There may be a floor structure, such as a poured concrete floor slab 34. Floor slab 34 may carry a wall structure 36 which may have the form of laid blocks 38, or which may in other embodiments include a framed structure, such as may be a wood or steel framed structure.

Visible facing elements 24 may include brickwork 40, or stonework, be it rough stone or finished stone, or other cladding. The anchor system may support masonry veneer, thin granite veneer, large stone panels or pre-cast concrete in place of the bricks. In FIG. 1, facing elements 24 are shown as bricks 42 laid in successive courses. Support assembly 26 may include a base or bench or first member 44 in the form of a "shelf angle", or angle iron 46. Shelf angle 46 may be an angle iron that runs along the wall structure in the horizontal direction, and provides the bed upon which the lowest course of bricks finds its support, hence shelf angle 46 may be termed a brick support. First member 44 may be mounted to a second member 50, which may have the form of a support bracket or mounting bracket 52. Second member 50 it itself fixedly mounted to the load bearing wall structure. The vertical load of the facing, e.g., bricks 42 is carried by the bench or "shelf" of first member 44, and passed into such number of second members 50 as may support first member 44. There are at least first and second support members 50 spaced laterally apart along the wall or supporting wall structure. For example, there may be several such supports on, for example, 24" centers, which may correspond to the spacing, or double the spacing of wall studs in standard framing. Second members 50 may then carry the shear load from first member 44 into the load bearing wall structure. The depth of second members 50 in the y-direction (i.e., normal to the wall) may typically be less than the vertical height of second members 50, such that the webs of second members 50 may be considered low aspect ratio beams in which the bending moment is small, or negligible.

Second members 50 are secured to load bearing wall structure or building structure 22. The securement may be, for example, mechanical securements such as threaded fasteners or expanding fasteners or anchors 54. In securement to a poured concrete wall or floor slab (as shown), fasteners 54 may be concrete anchor fittings, as in FIG. 1, or embedded threaded rods, studs, or bolts. On installation, the anchor foot is inserted in a preformed (typically pre-drilled) socket such as a blind hole formed in the concrete slab, and the fastener is tightened, drawing the collet or mandrel into the segmented shank, forcing it to expand and bind in the blind hole. As tightened, the underside of anchor head flange bears upon a spreader or washer, or spacer, and the nut is tightened against it.

Second members 50 have a depth (in the y-direction) that may correspond to, or may be greater than, the thickness of insulation panels 56 such as may be mounted to the front (or outside) face of the structural load-bearing wall assembly 22. There may also be a drainage shield, or flashing, 58 such as may encourage moisture to drain outwardly of and away from structural wall assembly 26. A vapour barrier membrane 59 may be captured behind insulation panels 56. Flashing 58 may traverse insulation 56 at the level of shelf angle 44 with its lowermost margin draining over angle iron 46, the lowermost margin terminating outwardly at a drip edge 48, such that any moisture draining over vapour barrier 59 is drained away. That is, a continuous metal flashing 58 is supported on or above shelf angle 46. It may connect to a continuous flexible flashing which extends over the brick supports and that may connect to a vapour barrier membrane. Sheets of rigid insulation 56 may be mounted over top or otherwise outwardly of the membrane of vapour barrier 59 on the outer face of the wall. The anchor system shown allows cavity insulation 56 to be continuous behind the brick support. The rigid insulation may be of a thickness that allows an air space or gap 'G' between the insulation and the external veneer brick facing 40 mounted on shelf angle 46. The angle support brackets 52 may be made in a variety of sizes each corresponding to a desired thickness of the rigid insulation and air space. In these arrangements, or embodiments, a standard size of brick support shelf angle 46 may be used without regard to the spacing between the brick facing and the face of the wall desired for insulation.

In some embodiments, tying members 28 may be located upwardly of support assembly 26. Tying members 28 may have the form of brick tie assembly 60, in which there is an anchor 62 and a brick tie 64. As may be noted, anchor 62 has a body 66 such as may have the form of a stamped steel plate. The distal portion of body 66 may be termed a tail 68. Tail 68 may have a length in the y-direction (i.e., into the wall) corresponding to the through thickness of cinder blocks 38, and such as may be located between adjacent blocks of a block wall and embedded in the mortar therebetween. Alternatively, tail 68 may be embedded in a further poured concrete wall, as may be. To that end, tail 68 may have perforations such as may permit mortar (or poured concrete) to flow therethrough. Body 66 may also have a proximal portion 70 of a depth in the y-direction corresponding to the thickness of insulation panel 56. Proximal portion 70 may be perforated to reduce thermal conduction in the y-direction. Proximal portion 70 may have a step, or abutment, or indexing or locating feature, such as a shoulder, by which the correct depth position in the y-direction is obtained relative to the cinder block and the insulation. Body 66 may also have an outermost end portion having an array of tie location apertures, or seats or positions. A faceplate seats on the outside face of the insulation and may be used on installation where the positioning of anchor 62 is set prior to installation of tail 68 in a poured concrete form. Brick tie 64 is then located in one or another of the seat positions. When the successive courses of bricks 42 are laid, the outermost ends of brick tie 64 are embedded in the mortar between courses, as suggested in FIG. 1. Tying members as described are used where the air or insulation space between the load bearing structure and the external veneer exceeds one inch, and in all cases where the wall height exceeds 30 ft. Tying members as described may be placed on up to 24 inch spacing vertically, and up to 32 inch spacing horizontally.

Considering FIG. 1, FIG. 2, and FIG. 3, support bracket 52 may have the form of a channel 80 (as viewed from above or below, as in FIG. 5*d*) having a first member in the nature of a rear plate or back 82, and a second member in the nature of a web or leg 84. Channel 80 may also have a third member in the nature of a second web or leg 86. In the embodiment shown, legs 84 and 86 stand outwardly of back 82. That is, as installed back 82 may lie in an x-z plane abutting the load bearing structure 22, be it framing, metal girders, poured concrete wall or poured concrete slab, and so on. Legs 84 and 86 stand outwardly away from that y-z plane. In context that outwardly direction may be termed forwardly away from the wall. In general, it may be convenient that legs 84 and 86 stand in y-z planes perpendicular to the plane of back 82, standing spaced apart and parallel, but this is not necessarily so. For example, legs 84, 86 could be splayed to form a V or winged shape as opposed to a square-sided U. In the particular embodiment illustrated, legs 84, 86 are a pair of side plates that extend from respective sides of the rear plate, back 82, in a direction away from the wall to form the sides of the U-shaped channel. The side plates are generally rectangular in shape and lie in respective vertical planes.

Back 82 may have a mounting, a seat, or an attachment fitting 90 such as shown in FIGS. 2 and 3 by which mechanical fastener 54 may secure bracket 52 to the load bearing structure. In general, in all of the embodiments herein a shim plate or plates 88, such as may be substantially similar in size to back 82 of anchor bracket 52, may be mounted between each anchoring bracket 52 and the outer face of the building structure or support structure, represented by wall structure 22 (i.e., load-bearing wall assembly 22), as may be suitable, for evenly engaging the concrete surface and for spacing each anchor bracket 52 from the wall as desired to accommodate irregularities in the outer face of the wall and for spreading the concentrated load of mechanical fastener 54 and mounting bracket 52 into the wall structure. Fitting 90 may be a slot 92 that permits height adjustment of bracket 52. Slot 92 may be oriented at a non-parallel angle or direction that is skewed, or oriented on a diagonal, relative to the vertical axis at an angle, theta. Slot 92 may be an elongate aperture in back 82 that extends along an inclined axis 72 angularly offset from vertical. The slot may be left-handed or right-handed, as may be. In one example, the inclined axis may be offset 22.5 degrees from vertical. The upright plate of back 82 can thus be fastened to the wall at numerous locations relative to the wall corresponding to different positions of the bolt within the slot.

The side plates defined by legs 84, 86 carry the brick support defined by shelf angle 46. Looking at leg 84 as being representative also of leg 86, the distal portion of leg 84 (i.e., the portion standing away most distantly from back 82) has a fitting, or accommodation, or seat 94 that is matingly co-operable with first member 44, and that provides a shear load transfer interface 96, e.g., in which a vertical gravity load from member 44 is transferred into web 84 (or 86 as may be). Seat 94 includes vertical reaction interface 96, and has a back that conforms to the shape of the back of first member 44. In the examples shown, seat 94 is generally L-shaped.

A moment restraint is indicated as retainer 100. In the version of FIG. 1, retainer 100 is a profile cut finger that overhangs the front of the vertical leg of shelf angle 46. In the version of FIG. 1, or FIG. 2, or FIG. 3, retainer 100 could also have the form of clip that includes, or can alternately be named as being, an upper reaction member, a securement, anchor, key, grip, lock or lock member, and so on such as may be taken as being the same as, or substantially the same as, any of the various alternatives of mounting brackets and clips shown in U.S. patent application Ser. No. 16/700,868 filed Dec. 2, 2019. The version of retainer 100 in FIG. 1 could be a clip that has the general form or a channel such as item 98 in U.S. Ser. No. 16/700,868, having a back and a pair of spaced apart, first and second members or legs, or arms, or fingers that extend away from opposite edges of the back. Retainer 100 may also be referred to as a clip, cleat, clasp or clamp; a lock or locking member, or key; a link; a securement or an engagement member. The first leg may be termed an anchor, or root, or catch, or hook. Similarly, the second leg may be termed an engagement member, finger, catch, claw, grip, holder, retainer or retainer member, and so on. The back may be referred to, or may define, the reach or grasp, or span of retainer 100 in the y-direction. The lower portion of the back of the L-shape can also be considered to be, or to define, a lower reaction member 102. That is, retainer 100, in particular outer finger 114 of retainer 100, and lower reaction member 102 present or define a pair of moment-couple reaction surfaces that co-operate to react the moment couple produced by the weight of the masonry veneer applied at the moment arm of the eccentricity of the veneer load relative to the vertical reaction interface 96.

Leg 84 (or 86) may have a stop, or abutment, or seat, or accommodation 104 that, in use is occupied by one arm or leg, or finger of retainer 100 is engaged or anchored. Accommodation 104 may be formed by cutting a notch or relief or rebate into the top end of legs 84 and 86. Back 82 may also be trimmed at the bottom end, and the rearwardly extending feet that may remain extend in the plane of the sidewalls, i.e., of legs 84 and 86. Retainer 100 over-reaches the upper end of the vertical leg of shelf angle 46, such that the other arm or finger, or leg of retainer 100 depends or extends in front of the uppermost margin of first member 44. This may tend to prevent its escape, and may tend to prevent it from rotating counter-clockwise as seen in FIG. 1 due to the eccentricity of the vertical load of the bricks. The inside face of the downward or distal tip of the finger may have the form of an abutment, or stop, or restraint that faces wholly, substantially, or predominantly in the –y direction, defining an upper reaction member. As may be noted, during installation, retainer 100 slides downward into place to engage, i.e., to capture, the upper end of the back wall of the shelf angle to the front edges of the seats of the mounting bracket.

Vertical reaction interface 96 may be defined as the upper face of the toe, edge, or side of an extending portion or member, or abutment, or stop, or lug, or dog, or toe 108, however it may be called, such as may be or may define a protruding extension or protrusion in the y-direction of the lower margin of leg 84. That is, in the embodiment illustrated the recessed channel shape of seat 94 includes a shoulder at a bottom end. That shoulder defines vertical reaction interface 96, and it carries the shelf angle, such that the brick supporting flange extends laterally outward from the wall.

Lower reaction member 102 extends upwardly and away from the root of toe 108, and has the form of a wall or edge that faces wholly, substantially or predominantly in the +y direction. A fatigue detail, or stress relief detail, in the form of a finite radius relief is provided at the root of the intersection of vertical reaction interface 96 and lower reaction member 102. The upper and lower stops (i.e., 100 and 102) constrain the translational degree of freedom of corresponding upper and lower regions of the back of shelf angle 46, and thus define a moment-couple reaction inhibiting motion in the rotational degree of freedom about the x-axis of angle iron 46 in the counter-clockwise direction.

In the embodiment of FIGS. 1 and 2, shelf angle 46 is mounted at a height that corresponds generally to the height of the attachment interface of back 82 to the load-bearing support wall structure. By contrast, the embodiment of FIG. 3 has a mounting bracket 130, rather than 110 or 52, in which mounting bracket 130 is a "long legged" version in which mounting the height of the seat of shelf angle 46 is well below the level of the wall mounting fitting represented by the mechanical fastener such as anchor 54.

The brick support defined by angle iron 46 includes a mounting flange that engages anchor bracket 50, and a supporting flange arranged to carry bricks. The mounting flange and the supporting flange may typically be mounted at right angles to form an L-shaped angle iron, typically made of steel. As in the various Figures, angle iron 46 has a first or horizontal leg 116 and a second or vertical leg 118. Horizontal leg 116 extends forwardly (in the +y direction) away from vertical leg 118, and hence on installation also forwardly and away from bracket 52. Horizontal leg 116 runs along the wall structure in the x-direction. Typically, the running length of the angle iron is much greater than the horizontal leg length. For example, in one embodiment the running length may be 72 inches, while the leg of the angle may be 6 inches or less. In various embodiments the x:y aspect ratio of lengths may be in the range of 4:1 to 16:1. In other embodiments the running length may be 20 ft. or 40 ft., or a portion thereof as cut-to-length, giving an aspect ratio of 4:1 to 100:1. Bracket 52 may be cut to length as may suit. As installed, the length of leg 116 proud of the end of toe 108 in the y-direction may have a length corresponding to the depth in the y-direction of the facing members to be supported. In the case of face brick, that length corresponds to the depth of the face brick. In some embodiments it may be somewhat less than the depth of the face brick to permit the iron to be less noticeably visible, or to be hidden as in FIG. 1.

In FIGS. 1, 2 and 3, vertical leg 118 has an accommodation, slot, aperture, socket, or relief, or reliefs 120 spaced upwardly from the junction of members 116 and 118. The lower margin of relief 120 may be located at or above the run-off of the rolled radius between members 116 and 118, i.e., in the tangent portion of the vertical leg, rather than in the radius. Reliefs 120 are sized to receive the dogs, or toes 108 of web members 84 or 86. They are over-sized in the x-direction to permit lateral adjustment of bracket 52, as, for example, according to the fastener position along inclined slots 92. For half inch thick legs, the slot may be 2.5 inches wide, giving, potentially, one inch play to either side of center. The height of the slot may be slightly oversize to permit rotating installation of bracket 52. The vertical through thickness of each toe 108 may be 1" or more.

In the engagement of toe or dog 108 in accommodation or relief 120, as may be, it may be that the lowermost margin of leg 84 (or 86) does not extend lower than (i.e., downwardly proud of) the bottom of horizontal leg 116, such that no additional vertical clearance allowance is required for toe 108, meaning that the toe is concealed behind the external veneer and the bottom edge of the lowest course of bricks may be lower than otherwise. Expressed differently, in terms of a seating arrangement of structural members, second member 50 is the receiving member, and first member 44 may be considered to be the received member. In the arrangement of shown the received member is flush with, or extends downwardly proud of, the lowermost portion or extremity of the receiving member and may tend to conceal the receiving member from view. The engagement of the receiving and received members is a mechanical interlocking relationship that is biased into securement by gravity acting on the load. That is, while the angle iron may be adjustable and engageable while unloaded, the loading of bricks or other surface elements may tend to increase the moment couple on the angle iron, such as may tend to tighten the hold of the moment couple reaction members of the receiving member.

The received member, such as shelf angle 46, is itself a receiving member, or accommodation, for the externally visible masonry veneer facing elements, and as the facing elements are received, rearward structure such as bracket 52 is obscured from view. The received member has a first portion that defines a seat or bench, or accommodation, or support, or platform or under-girding, or shelf, for the externally visible masonry veneer facing members, hence the term "shelf angle". It is a form of sill. The received member also has a second portion that engages the receiving member such that vertical load from the received member is transmitted or carried into the receiving member and thence into the load-bearing supporting structure. In that sense the second portion is an engagement fitting, or key, or interlocking feature, or indexing feature, that mates with the receiving member. An L-shaped angle iron may be a convenient form having these properties.

Considering FIG. 2, mounting support bracket 110 is similar to mounting support bracket 52, except that it is deeper in the y-direction, and the toe 108 is formed to fit through the apertures 120 in the shelf angle 46. This greater depth may correspond to a greater thickness of insulation, such as thermal insulation panel 56.

Inasmuch as each leg 84, 86 or 154, may pass through the wall insulation panels 56, each leg may also have an array of apertures as at 124, such as may reduce the section for heat transfer in the y-direction. In some embodiments apertures 124 may be non-circular, and may have an oval, oblong, or elliptical form. The form of aperture may have a long axis and a short axis. The long axis may be inclined at an angle to the perpendicular. In one embodiment the angle of inclination may be about 45 degrees. The interstitial strips 126 between adjacent apertures may tend to be inclined on a generally diagonal angle.

The foregoing description provides the structural context of the features of FIGS. 4*a*, 4*b* and 4*c*. FIG. 4*a* shows the elements of FIGS. 4*b* and 4*c*. However, FIG. 4*a* shows the various elements in their true proportions, or relatively close to true proportions. FIG. 4*b* shows the same elements, with the lengths of various portions foreshortened, or sections, such that the details are enlarged for easier understanding. The dimensions $D_1$, $D_2$, $D_3$ and $D_4$ are intended to symbolize the true dimensions, in general proportion as in FIG. 4*a*, with the annotation provided in FIG. 4*c* to show the corresponding features that have been foreshortened. The same commentary in respect of dimensions $D_1$, $D_2$, $D_3$ and $D_4$ applies to FIGS. 5*a* and 5*b*. As established in the geometry described above, the shelf angle support structure holds the masonry veneer facing assembly 24 laterally outboard from the facing 144 of the lower wall structure covering or cladding or paneling 140 by an overhang distance in the +y direction, designated as $Y_{24}$. In the example shown, that distance may create a step like an eave. This distance may be of the order of 6" to 20", or possibly more, depending on the circumstances. It is usually desirable that this space be obstructed to impede the entry of birds, mice, squirrels, chipmunks, raccoons, skunks, and so on. It may also be desirable to conceal substantial structural members such as shelf angle 46 and mounting support brackets 52, as may be.

To that end, there may be a closure assembly, in the form of a soffit assembly 150. There are different embodiments of closure assembly 150. In the embodiments seen in FIGS. 2, 3 and 4*a*, 4*b* and 4*c*, closure assembly 150 includes a first member 152 and a second member 154. In this first embodiment, first member 152 is a soffit 160, and second member 154 is a termination member. In the example shown, second member 154 is continuous in the direction and is a rail, and may be referred to as a J-strip.

Soffit 160 has a first leg 162, a second leg 164, and a back 166. First leg 162 is an upper leg and second leg 164 is a lower leg. Back 166 joins them at their roots. The legs are not symmetrical. Upper leg 162 has a length that is less than the inside length of the upper surface of the horizontal leg 116. The length of horizontal leg 162 may be, and in the embodiment illustrated is, more than half the width of a brick of standard face brick dimensions. In North America the dimensions of a standard face brick are typically 7⅝" long; 3⅝" deep, and 2¼" high. The length of leg 162 can be taken as being in the range of 2 inches to 4 inches, such that when installed leg 162 overlies leg 116 of shelf angle 46, and the mortar and masonry seat on top of leg 162. As installed, leg 162 cannot thereafter escape.

In contrast, the lower leg 164 has a length that corresponds to the length of a soffit of corresponding size to the eave, and with an inside margin (i.e., the terminating edge of leg 164 most distant from back 166) that engages with the J-strip or P-strip defined by second member 154. Back 166 has a width that is the same size as, or, more generally, corresponds to, the vertical through-thickness of horizontal leg 116 of shelf angle 46. Upper leg 162 and lower leg 164 are spaced apart by a distance that, at least nominally, corresponds to the reach defined by the width (i.e., the vertical dimension) of back 166. It may be helpful for the legs of first member 152 to be pigeon-toed. That is to say, they are not parallel, but rather the tips distant from back 166 are closer together than the roots at back 166. In such a circumstance, on installation the tip of upper toe 162 rides onto the roll-off radius of the tip of the horizontal leg of the hot-rolled angle iron of shelf angle 46, like a cam-follower, and first member 152 then engages horizontal leg 116 in an interference fit, and squeezes leg 116, thus discouraging removal. One way to do this is to form first member 152 such that legs 162 and 164 are tapered toward each other. On installation the legs flex apart slightly, and carry a spring pre-load. The tightness of the squeeze merely needs to be tight enough for installation, prior to the installation of the masonry veneer.

Shelf angle 46 may be understood to be a hot-rolled steel shelf angle as received from the steel mill and then cut to length. Facia, soffits, and soffit receiving rails such as J-strips and P-strips may typically be made of aluminum sheet, or sometime plastic extrusions. Most commonly, in North America, soffits are made of aluminum. Accordingly, it may be desirable to place a galvanic barrier between the steel and the aluminum.

In that regard, optionally, or additionally, a separation layer, or isolating layer such as a double-side tape, or a membrane of plastic sheet such as a Nylon™ or UHMW polymer sheet can be mounted on the underside (i.e., the inside face) of leg 162, and such portion of the upper face, or upper side of lower leg 164. In a further alternative, the underside of leg 162 and the upper side of leg 166 can be provided with a surface coating, or treatment. That surface coating may be anodizing, or paint, or an epoxy coating.

In general, it may be said that first member 152 has a first portion, or a first engagement interface that interacts with the shelf angle, and, in particular, engages the outboard tip of horizontal leg 166. In the example given, the channel defined by legs 162, 164 and back 166 defines the first engagement interface in the form of a female socket 168 that seats on, mounts to, or mates with, the male engagement member defined by the tip 170 of the horizontal angle iron leg of shelf angle 46. First member 152 also has a second engagement interface, distant from the first engagement interface, that mates with the inboard mounting member defined by second member 154. In the example, the second interface is defined as the prong or insert edge 158.

Second member 154, which has the form of a P-strip or J-Strip, defines the mating engagement interface that interacts with first member 152. In the example shown, that mating interface is folded over to form an engagement interface 172 that has the form of, or includes, a socket or slot or receiver 174 into which tip 170 inserts. In this example, receiver 174 defines a female member and tip 170 defines a male member, the one being engageable with the other. It is to some extent arbitrary whether the female member is formed on tip 170 or on second member 154, or the other way around.

As above, second member 154 has the form or a J-strip having a first leg 176 and a second leg 178, the first and second legs being joined at a corner. First leg 176 is a vertical leg that is attached to the supporting building structure typically be using mechanical fasteners such, as screws, that screw into external cladding of the adjacent vertical wall paneling. In the example shown second leg 178 is a horizontal leg. Leg 178 has a folded over outermost end, the end having a first bend 180 that defines the outboard lower edge of slot 174 and, by being folded, does not have an exposed sharp edge upon which a person might otherwise cut themselves. It has a re-entrant fold or run 182 that extends to a second bend or inboard bend 184 that forms the bottom or inboard end of slot or receiver 174, of engagement fitting 172. Fitting 172 then has a further outward run 186 that terminates at a smooth edge. In this case, the smooth edge is formed by making a further bend, a third bend 188, and folding the free edge run 192 back inwardly into slot or receiver 174 to form the outboard upper edge of slot 174 so that, once again, no sharp edge remains exposed.

When the building structure is erected, and mounting brackets 52 and shelf angle 46 are installed. Second member 154 of soffit assembly 150 is mounted to the exterior of the lower cladding materials of the building, such as cladding or paneling or facing 144. First member 152 is then slid into place, first by introducing the tip 190 of horizontal leg 116 into the channel between legs 162 and 164, and then by advancing first member 152 in the −y direction to introduce the inboard edge or tip 170 of soffit 160 into slot 172.

In the alternative of FIGS. 5*a*, 5*b* and 5*c*, there is a soffit assembly 200 that rather than being made of two assemblies or two fittings, as in assembly 150 of FIGS. 4*a*, 4*b* and 4*c* is made of three assemblies or three fittings. The three assemblies are an engagement interface in the form of an outer rail, identified as fitting 202, and another engagement interface member or inner rail identified as fitting 204, and a closure panel in the form of soffit 206 that extends between and mates with, the inner and outer rails 204, 202. That is, assembly 200 has a fitting 204 in the form of the J-strip of second member 152 as before. As installed fitting 204 defines an inner rail mounted to the external cladding 144 of the lower portion of the building structure. By contrast, first member 152 of FIGS. 4*a*, 4*b* and 4*c* is replaced by an outer rail in the form of engagement member or fitting 202, and a separate closure member or soffit 206. Engagement member 202 includes an upper leg 208 and a back 206 that correspond to, and for the purpose of this description may be taken as being the same as, upper leg 162 and back 166. Lower leg 212 may be taken as being the same, or substantially the same, as leg 178 of fitting 154. Engagement member or fitting 202 provides a slot or receiver 214 that may be taken as being the same as, or substantially the same as, the slot or receiver 174. Soffit 206 then has a first margin 216 and a second margin 218, each of which corresponds to insert edge 158, and that seat, respectively, in slot 174 of inboard rail fitting 204 and slot 214 of outboard rail fitting 202.

In North America, aluminum soffit tends to be supplied in pre-fabricated roll-formed sheets that are 17½" wide and 10 ft long. They have pre-formed longitudinally running stiffening ridges on 4" centers. They are sold in both solid sections and perforated sections, and, on installation, it is common for every third or fourth section of soffit to be a perforated section to allow the eaves to breathe. In the alternative of FIGS. 5*a*, 5*b* and 5*c*, it may be that the eave distance is either a non-standard dimension, or may not be a constant dimension, it may taper or fluctuate depending on whether the wall structure as assembled is square and true. In that case, a pre-fabricated soffit and rail construction as in FIGS. 4*a*, 4*b* and 4*c* may not be suitable. Moreover, the external veneer masonry may be installed upon the shelf angle before the installation of soffits, to prevent the soffit from being damaged during construction. In such instances it may be helpful to install the outer rail defined by engagement member or fitting 202 on the tip 190 of horizontal leg 116 of shelf angle 46, and then to install the masonry veneer such as brickwork 40 prior to installation of soffit 206. Soffit 206 is then cut to length as suitable and inserted by longitudinal sliding in the x-direction, such that first margin 216 (i.e., the inboard margin) seats in receiver 174 and second margin 218 (i.e., the outboard margin) seats in receiver 218. The running edges of soffit 206, i.e., in the y-direction perpendicular to the inboard and outboard rails, generally have a straight edge on one side and a mating straight edge with an accommodation on the other side such that one fits into another in an overlapping fit as the adjacent soffit sections are slid into place. When the last soffit section is being slid into place the installer gently deflects the inboard receiver rail or the outboard receiver rail, or both sufficiently to permit the slightly flexed last piece of soffit to engage the respective tracks defined by the slots in the receivers 174 and 214, and once they are popped or coaxed into place the inboard and outboard rails 202, 204 are deflected back into the proper horizontal plane so that the finished rail has a straight and level appearance. This may be achieved by use of a wooden member, be it a length of 2×4 or 2×6 to cause the lip of the rail to be smoothly positioned, rather than puckered, for example.

The result is that the soffit assembly 200 has three components. As described above, it has a first member or first fitting 204 that mounts to toe 190 of the horizontal leg 116 of shelf angle 46; it has a second member 202, 154 or second fitting that mounts to the building structure 144; and it has a third member that defines the soffit panel 206 that extends between the first and second fittings 202, 204. First fitting 202 has a first interface that is, or defines, an accommodation or seat or socket 220 that mates with toe 190 of shelf angle 46; and a second interface 222 that is, or defines an accommodation, or seat or socket, such as slot or receiver 214 that receives the outboard edge 218 of soffit 206. The second fitting 202 has a first engagement interface, or mounting fitting, 224 at which it is attached to the building structure, namely the vertical leg 176 that is secured by mechanical fastening hardware to the structure. The second fitting has a second engagement interface 226 that is, or defines, an accommodation, or seat or socket that such as slot or receiver 174 received the inboard edge 216 of soffit 206. This approach permits the use of pre-fabricated soffit panels such as are sold at building supply outlets, that may be bought in standard lengths and cut to length in installation as suitable.

In the assembly of FIG. 1, it is presumed that, on installation a flashing overlies first leg 162 of first member 152. In FIG. 1 that flashing is shown as item 58 which has an upper flange that is oriented on a slope to encourage the draining of condensation, if any, away from the supporting structure 22 toward the air gap between insulation 56 and the facing veneer brick 42. It then has a vertical, or substantially vertical leg that seats in front of, and spaced from, vertical leg 118 of shelf angle 46, and a further horizontal leg that overlies horizontal leg 116 of shelf angle 46 and overlies horizontal leg 162 of first member 152 of soffit assembly 150. The outermost edge of the horizontal leg of flashing 58 may end in a drip edge 48, which may be formed by bending the margin of the flashing downward, typically at 45 degrees, and then bending the otherwise exposed sharp free edge and folding it back and upward underneath the angled edge so that no sharp edge is exposed. The lower edge of a membrane defining a vapour barrier 59 then overlies at least a portion of the upper sloped leg of flashing 58, so that condensation on the outside of vapour barrier 59 may tend to drip down onto the sloped portion of flashing 58, and be drained away. In North American practice, flashing 58 may be made of 22, 24 or 26 ga. steel sheet that has been either roll-formed or bent in a break. The flashing is painted or otherwise coated so that the steel is protected from moisture to discourage rust.

There may be instances where there is no flashing, and therefore no drip edge above the soffit assembly. In those circumstances it may be that the soffit assembly includes a drip edge. In the alternate versions of FIGS. 6*a* and 6*b*, which correspond to the version of FIGS. 4*b* and 5*b* respectively, whether the flashing has a drip edge or not, it is seen that the outboard rail fitting of the soffit assembly is provided with a drip edge, indicated as 228. A drip edge may tend to be desirable in a climate in which rain is not infrequent, or where there is ice accumulation in Winter, followed by cycles of melting and freezing. The drip edge tends to discourage capillary migration of moisture upward and into the soffit assembly and other structure more generally. As can be seen, the drip edge is formed by bending and folding additional sections of the aluminum sheet from which the soffit and facia members may customarily be made.

FIG. 7*a* is substantially similar to the embodiment of FIG. 1. It differs in that masonry veneer support mounting bracket 52 of FIG. 1 has a vertical load transfer support interface—i.e., a toe—that passes through, and seats in, apertures formed in the back, namely vertical leg 116 of shelf angle 46. By contrast, in veneer support mounting bracket 234 of FIG. 7*a*, the vertical load transfer interface toe 236 locates underneath horizontal leg 116 of shelf angle 46, such that the shelf angle is supported from below as opposed to being supported through the back of shelf angle 46. The practical corollary of this embodiment is that dimension $D_2$ in the underlying concealment soffit assembly is deeper than in FIG. 1 by an amount sufficient to pass below toe 236. That is, $D_2$ is deeper by the depth of toe 236.

FIG. 7*b* is substantially similar to the embodiment of FIG. 1. In this case a masonry veneer support assembly is indicated generally as 240. There is a concrete foundation 230 and a masonry block wall 232 that has been laid on top of the concrete foundation. The masonry veneer elements are again shown as 24 with bricks 42.

As may be recalled, in the mounting assembly of FIG. 1 there are mounting brackets 52 that mount to the supporting wall structure 32, 34 and the shelf angle 46 is introduced into seats 94 of mounting brackets 52. Shelf angle 46 is held in place not by any fastening, but merely by the geometry of the seat and, eventually, the weight of the masonry veneer on the horizontal leg.

The mounting assembly of FIG. 7*b* differs from that of FIG. 1 in that rather than a releasable geometric seat, there are steel brackets 242 that have a single or double-webbed vertically extending member 244 that terminates at an upper fitting that receives a mechanical fastener that may typically be, or include, a concrete or masonry anchor 238. At the lower end of vertically extending member 244 there is a foot, or lower engagement interface member 246 in the form of a bracket or tab 248. In the example, bracket 248 has a ridged back side that mates with a similarly ridged plate or pad 252 that is welded to member 244. Bracket 248 has an oval opening that allows the position of the abutment to be adjusted to abut the supporting structure, such as the concrete foundation, as suitable. On installation bracket 248 is adjusted and the mechanical fastener of bracket 248 is tightened such that the respective sets of ridges engage and lock in the suitable position. Shelf angle 250 is welded to the forward edge of member 244 and such other members 244 as may be spaced along the face of the wall.

In this arrangement, the concealment members may be those of assembly 150 of FIGS. 4*a*, 4*b* and 4*c* as described above, namely items 152 and 154. Alternatively it may employ items 254, 256, where item 254 may be the same as item 152. It may, alternatively, have a stepped lip or toe 258. Item 256 could be the same as item 154 or, alternatively, as shown in FIG. 7 it may be a J-strip 260 that has a vertical leg 262 that fastens to the wall structure, and an outwardly extending, horizontal leg 264, upon which toe 258 seats.

As before, a flashing 270 sits on top of the re-entrant top leg 162, and bricks 42 sit on top of the flashing 270. Condensate that may form then drips down the flashing. Accordingly, the wall mounting assembly can be made of a unitary welded structure, as opposed to an assembly of mounting brackets with seats into which the shelf angle is placed on installation at the job site. The supporting angles need not be open channel sections, but can be single webs or a U-shaped double web in which the back of the U faces outward.

In the embodiments of FIGS. 8*a* and 8*b*, there is a situation in which there is a foundation 280. It may be a poured concrete foundation, or a laid block foundation. There is a floor slab 282 that is carried upon foundation 280. Floor slab 282 has an overhang 284 that stands outwardly away from the outside of foundation. As in FIG. 1, there are mounting brackets 52 mounted to the exposed face of the floor slab. They are held in place by concrete anchors 54. As before, shelf angle 46 is carried in the seats of the various mounting brackets. It can have the same concealment closure arrangement as in FIG. 7 or as in FIGS. 4*a*, 4*b* and 4*c*, whether with parts 152, 154 or with parts 254, 256 as previously described. As before, a flashing with a drip edge sits over the return leg 162.

However, in this case there is a spaced insulated cladding or paneling 290 that is mounted to the outside face of the lower wall defined by foundation 280. In this arrangement paneling 290 is mounted to brackets 292. Brackets 292 are secured to foundation 280 with mechanical fasteners. Brackets 292 provide a stand-off spacing between paneling 290 and foundation 280. In this instance, the upper edge of paneling 290 has a stiffening member, identified as rail 294. A squeezable foam strip 296 is located between rail 294 and the underside of the overhang 284 of slab 282. A sealant, such as a bead of caulking 298 is run along the outside of strip 296.

As may be noted, the embodiment of FIG. 8*a* leaves an exposed portion of the underside of slab 282. By contrast, in the embodiment of FIG. 8*b*, there is the same issue of an overhanging slab 282. However, in this instance the concealment assembly includes a first member 302 and a second member 304. First member 302 includes re-entrant leg 162 that seats over the tip of the horizontal leg 116 of shelf angle 46, and has substantially the same configuration as item 254, above. In this case the step of the toe locates on top of strip 296. Second member 304 has the form of a supporting J-strip 306. In this case, J-strip 306 has an inverted horizontal leg 308 that runs underneath slab 282 rearwardly of the front face of slab 282. The supporting horizontal leg or tip 310 hangs downwardly from the inboard end of the horizontal leg of J-Strip 306. In this way the underside of slab 282 is covered, and concealment assembly 300 provides both the outward appearance of the finished soffit, and excludes birds and rodents, as may be.

Thus, the assemblies of FIGS. 8*a* and 8*b* show that the concealment assembly can define a full or partial soffit, and may co-operate with a lower veneer wall, or paneling, such as may be spaced outwardly of the foundation or other supporting structure, and may include an insulation layer and airspace, as suitable. This approach stands in contrast to embodiments such as that of FIG. 1, in which the soffit structure may extend to, and may be anchored to, the supporting wall structure. They also show the use of a seal, in this case combining a sealing strip and caulking at the transition, or mating interface, of the concealment structure (i.e., the soffit or its associated J-strip or P-strip) with other external cladding structure.

Whether in FIG. 7, FIG. 8*a* or FIG. 8*b*, the enclosing soffit structure may be a two-piece assembly as in FIGS. 3, 4*a*, 4*b* and 4*c*; or a three-piece assembly as in FIGS. 5*a*, 5*b*, 6*a* and 6*b*. In general, the features of the various alternate embodiments may be mixed and matched as appropriate without the need for exhaustive and repetitious illustration and description of all of the possible permutations and combinations.

Thus far the discussion has assumed the use of a soffit concealment apparatus in connection with the use of a shelf angle that mounts in channel-shaped mounting fittings that have a profile cut to define a shelf angle seat. An example of this kind of mounting is the mounting bracket shown and described in U.S. Pat. No. 6,128,883 of Hatzinikolas. However, the cavity concealment apparatus may be used with other kinds of bracket assemblies, including pre-welded assemblies that use, for example, perpendicular plates that are welded to the back of the upstanding legs of the shelf angles. The apparatus shown in FIGS. 9*a* to 9*f* are intended to show soffit concealment apparatus used with such alternate welded assemblies.

FIG. 9*a* shows a building structure assembly 320 having a wall girder in the form of an I-beam 322 carried on supporting structure, which may have the form of vertical steel posts 324. A joist 326 is carried on the upper flange of I-beam 322. Joist 326 has a cantilevered extension 328 that is carried outboard of I-beam 322 and defines an overhang. It may be understood that there is an array of such joists 326 spaced along I-beam 322 such as to form the supports of a floor structure 332. There may, of course, be further posts 304 and girders 302 built up to define additional storeys and floors of the building, as may be.

A masonry veneer support assembly is identified as 330. It is employed to carry masonry veneer such as bricks 42 or such other masonry as may be. Masonry support assembly 330 includes a set of first members 334 that are mounted to, and extend downwardly from, a plurality of the joists on such spacing as may correspond. In some instances, the spacing may be 4 ft., for example. First members 334 are made of mild steel and may be referred to as knives or knife plates. The outboard end of the knife extends outboard of the joist by some distance. That distance may in some cases correspond to the thickness of insulation to be installed, plus an air gap for the draining of such condensation as may be. The shelf angle 336 may have a set of stems 338 welded to the back of the upstanding leg of the shelf angle. Stems 338 may extend perpendicular to the running direction of shelf angle 336, and have a number and pitch spacings corresponding to the number and spacing of the knife plates. On installation stems 138 are bolted or otherwise mechanically fastened to the knife plates 334. In this assembly, the weight of the masonry veneer, once installed, creates an overturning moment not only on masonry support assembly 330 but also on the respective cantilevered end portion 328 of joists 326. In that regard, assembly 330 has a strut or brace 340 that has an upper end welded to a respective knife plate, or first member 334 and a lower end that is welded to the lower extremity of the web of I-beam 322, and which may be welded to a gusset 342 that is webbed to the I-beam web, very close to the bottom flange. In some instances, the bottom edge of the strut/gusset combination may be welded to the upper side of the lower flange of the I-beam. As seen in the example illustrated in FIG. 9*a*, strut or brace 340 extend on an oblique angle, or diagonal, upwardly and outwardly from the lower flange of I-beam 302 to shelf angle 336. Struts or braces 340 then function to react the overturning moment due to the weight of the masonry carried at its cantilever distance from the center of the web of I-beam 322.

In this configuration, it may be desired to enclose the space underneath the structure from the outboard tip of the horizontal leg of shelf angle 336 to the underside of I-beam 322. To that end there is a concealment apparatus, or shroud, or cowling assembly 350. It has a first portion 344 that engages shelf angle 336, a second portion 346 that engages the supporting building structure, in this case the lower flange of I-beam 322, and a third portion that in the illustration has the form of a spanning member, or cowling, 348 that extends between, and closes the open gap between, first portion 346 and second portion 344. In the example shown, first portion 344 and second portion 346 are separate pieces that are individually mounted to shelf angle 336 and I-beam 302, respectively. Cowling 348 then functions a soffit, except having a dog-leg shape to enclose the plane underneath the knives 334, while conforming to the diagonal of structs or braces 340.

In the specific example shown, first portion 344 and second portion 346 are both roll formed sheet metal members that have the form of engagement clips. Considering first portion 344 first. As seen in FIG. 9*b*, first portion 344 has, in essence, first, second and third elements 352, 354, and 356, which can also be referred to first, second, and third legs. First portion 344 has a back 360, and a bent leg 362. In the example shown, bent leg 362 has a length that is less than the horizontal depth of a brick 42. In use, bent leg 362 seats on top of the horizontal leg 358 of shelf angle 336.

At the opposite extremity, or edge, or vertex of back 360, there is a second leg 364 defined by third element 356. The second leg is bent back upon itself. It has an outside fold 366 and an inside fold 367 that has been bent back toward back 360. There is a further leg or fold 368 that is bent from fold 367 in another reverse of direction to extend away from back 360. The tip 369 of fold 368 is bent back upon itself to form a clean folded edge 370.

In the uninstalled, undeflected orientation or condition of first portion, the spacing between bent leg 362 and fold 368 may be, and in the example shown it, smaller than the thickness of horizontal leg 358, and fold 368 is more narrowly close to leg 362 at its end more distant from back 362 than at its root most proximate to back 362. At its root, the space is equal to or greater than the thickness of leg 358. Thus, there is a seat 372 defined between leg 362 and fold 368 (i.e., between first element 352 and second element 354). On installation there is an interference fit such that leg 358 spreads first element 352 and second element 354 apart. That is, first portion 344 defines a spring between first element 352 and second element 354. On installation the spring grasps leg 358 of shelf angle 336.

Similarly, there is a second accommodation or seat 374 defined between second element 354 and third element 356 of first portion 344. Third portion 348 has a first edge or end 376 that engages first portion 344 and a second edge or end 378 that engages second portion 346. On installation first end 376 engages second seat 374. In the embodiment shown, first end 376 is a male engagement fitting that inserts into the female engagement fitting defined by second seat 374. This male-female arrangement could be reversed as between first portion 344 and second portion 346.

At the other end, as seen in FIG. 9*c*, second portion 346 has a first element 382; a second element 384 and a third element 386. First element 382 is joined to second element 384 by a first back 388. Second element 384 is joined to third element 386 by a second back 390. The overall arrangement of the first second and third elements is to form an interface member having generally a Z-section or Z-shape. In the example shown, first element 384 has the form of a leg 392, second element 384 has the form of a second fold or leg 394, and third element 386 has the form of a leg 396 that has a first fold 398 and a second fold 400 in the form of a reverse bent tip, that is bent back on itself inside first fold 398, such that leg 396 presents a clean folded (and painted) external edge, rather than a sharp cut metal edge. As can be seen, leg 392, back 388 and leg 394 combine to form a channel. The inside of the channel defines a first accommodation or seat 402 into which the tip of the lower flange of I-beam 322. As before, the tip of the channel is narrower than the root, and defines a clearance that is slightly smaller than the thickness of the I-beam, such that insertion of the flange tip in the channel forces the tip of leg 392 to deflect away from second leg 394. As before, the socket or accommodation is a spring, and this interference fit imposes a spring pre-load to grip the toe of the flange of the I-beam.

Similarly, the folded back toe of third element 386 leaves a clearance between the tip of leg 396 and leg 394 that is smaller than the thickness of second end 378. Accordingly, insertion of second end 378 in the slot, or seat, or accommodation 404 defined between leg 396 and leg 394, tends to pry leg 396 away from leg 394, resulting in an interference fit. As before, the combination of legs 394, 396 and back 388 in their channel configuration defines a spring, and insertion of end 378 in the seat causes a spring pre-load to be developed such that second end 378 is gripped in the seat.

As noted, third portion 348 has first end 376 that forms the engagement edge of the first panel or section 406 of third portion 348. Third portion 348 has a second panel or section 408 that, as installed, enclosed the diagonal defined by the struts or braces. Third portion 348 terminates in its bottom end with a bent goose-neck 410 that terminates in second end 378. The material sheet thickness of third portion 348 is sufficiently small, and the overall arc length of material between ends 376 and 378 is sufficiently great that third portion 348 is flexible enough to permit first end 376 to be installed, and then second end 378 to be sprung into place.

Looking at FIG. 9*d*, there is a further alternative arrangement. In this case there is, again, an I-beam 322 mounted on posts 324 in a post-and-girder construction. In this case, steel floor joists 326 are mounted to welded gusset plates 418 that are welded within the inside of the web and flanges of I-beam 322. There is corrugated sub-floor 412 upon which there is poured a concrete slab floor 414 that has a cantilevered portion 416.

On the outside of I-beam 322 and lower than cantilevered portion 416 is a masonry veneer support assembly 420. Again, there is a knife plate, or set of spaced-apart knife plates 422 welded to the outside of the web of I-beam 322 and to the underside of the cantilever liner plate 424. Vertical angles 424 are attached to the outboard ends of knife plates 422 with mechanical fasteners. A shelf angle 336 is then mounted to the lower edge of the vertical angle irons, either by mechanical fasteners, as shown, or more permanently, by welding.

The exposed gap between shelf angle 336 and I-beam 322 is, once again, concealed by a soffit concealment assembly 430. Assembly 430 includes a first portion 432, a second portion 434, and a third portion 436. First portion 432 may be taken as being the same as, or substantially the same as, first portion 344, above.

Second portion 434 differs in that while second portion is Z-shaped, having a first engagement interface 438 that provides a seat that faces and engages the forward side of the lower flange of I-beam 332; a second engagement interface 440 that faces the opposite direction to engage the inboard edge of the soffit. In this example the third portion 436 has the form of a soffit 450 is a flat panel with inboard and outboard edges 446 and 448 that engage the sockets, or accommodations, or seats defined by first portion 432 and second portion 434 respectively. First engagement interface 438 and second engagement interface 440 are joined by an intermediate member in the form of a vertical leg 444. Leg 444 has a length corresponding to the height mis-match between the bottom flange of I-Beam 332 and the horizontal leg of shelf angle 336.

In the example shown, second engagement interface 440 may be understood to have the same, or substantially the same, arrangement as shown in inner rail fitting 204, with vertical leg 444 corresponding to vertical leg 210 in FIG. 5*b*. The upper fitting, engagement interface 438 is essentially the same arrangement turned upside down, with the direction of the seat opening reversed, i.e., to face the lower flange of I-beam 332, and the opening of seat 452 being greater than seat 214 such that the greater thickness of the flange can be accommodated. Moreover, in the version in FIG. 9*b*, the outside leg 454 is longer than inside leg 456, being the reverse of the arrangement of legs 182 and 186 in FIG. 5*b*. Whether in FIG. 5*b* or FIG. 9*d*, the resultant geometry defines a spring clip that has a spring pre-load when engaged. The use of light sheet metal soffits does not, of course, impede the installation of insulation in the gap as before.

In the example of FIGS. 9*e* and 9*f* there is a further arrangement. In this case I-beam 332 has been replaced by a closed structural section, in this case a rectangular or square steel beam 458 of hollow section. Although it could be offset at a different height from shelf angle 336, such as to require the use of an inclined panel as in FIG. 9*a*, or a stepped assembly such as Z-shaped second portion 434, in this example they are shown at the same height, such that a flat, planar member such as soffit 450 may be used. In this case, however, the enclosure or concealment assembly 460 has a further, fourth element. In this example, the fourth element is a termination strip, or runner strip 462 that is fastened to the inboard web of hollow beam 458, such as by mechanical fasteners 459. Runner strip 458 has a roll-formed upper edge that is folded back on itself to define a seat rail 464. As installed, seat rail 464 may be in contact with the web of beam 458. However, on installation of second portion 466, the reverse folded upper inner edge 468 of second portion 466 inserts between the web of beam 458 and rail 464, deflecting it away from the web of beam 458, forming an interference fit with a sprung pre-load. An outside vertical leg 470 then extends downward to the second engagement interface in the same manner as leg 210 in FIG. 5*b*, with the engagement interface with soffit 450 then being of the same geometry and nature as the engagement interface of soffit panel 206 in the spring clip defined between legs 186 and 182 in FIG. 5*b*. In this arrangement, when the overfolded upper leg seats behind rail 464, fastening hardware 459 is hidden from view, and the visible upper edge of the assembly terminates at a clean, straight, upper edge defined by the upper fold. In these examples, the soffit and rail construction is light weight sheet metal, typically steel. On some occasions J-strips and P-strips are made of extruded plastic for the same or similar purposes. On insertion, the folds are sufficiently flexible to permit elastic bending be hand to permit installation, and sufficiently resilient to spring back into the desired shape once installed.

In the examples of FIGS. 9*a*-9*f*, in previous construction shelf angle 322 would commonly have been a T-shaped steel section, with the stem of the T-shape oriented to stand upwardly, and the inside portion of the flange of the inverted T then being used to obstruct the otherwise open gap between the T-section and the wall. That gap might have been filled with insulation, with an air space being left between the outside face of the insulation and the inside face of the brick veneer. However, the use of a heavy steel T-section in this location may not always be desirable. First, T-sections tend to be less widely available, and the space of the gap may not be the same as the length of horizontal flange desired to underlie the face brick. Accordingly, either an asymmetric T must be specially ordered, or a symmetrical tee must have one of the legs trimmed. Standard L-shaped angle irons tend to be more widely available, and as standard sizes may tend to be available at lower cost. They may also tend to weigh less, given the absence of the inner portion of the cross-bar of the T as compared to a shelf angle. The light construction using a first element-namely an outer rail; a second element, namely an inner rail; and a third element in the form of a soffit that is cut to length to fit between the rails, may tend to permit much lighter construction, without the need for specially ordered heavy structural sections.

Various embodiments of the invention have been described in detail. As explained, the various embodiments described address one or more of the various problems and challenges of dealing with curved walls and with discontinuities or interruptions in a wall structure such as corners, windows, doors, the desirability of reducing heat transfer, the facilitation of manufacturing, and so on. Since changes in and or additions to the above-described best mode may be made without departing from the nature, spirit or scope of the invention, the invention is not to be limited to those details but only by the appended claims.

I claim:

1. A masonry veneer support assembly comprising:

a masonry veneer shelf angle, a first mounting bracket, and a second mounting bracket;

said first and second mounting brackets being attached to a building structure;

said shelf angle having a first leg extending upwardly, and a second leg extending forwardly away from said building structure;

said masonry veneer shelf angle being seated on said first and second mounting brackets; and a soffit mounted to said shelf angle, said soffit extending rearwardly of said shelf angle toward said building structure.

2. The masonry veneer support assembly of claim 1 wherein said assembly includes a further securement mounted to the building structure, and the soffit has an outboard margin mounted to the shelf angle and an inboard margin mounted to said further securement.

3. The masonry veneer support assembly of claim 2 wherein said further securement is a J-strip.

4. The masonry veneer support assembly of claim 2 wherein both said soffit and said further securement have an external coating.

5. The masonry veneer support assembly of claim 1 wherein said further securement has a folded strip defining a slot, and said soffit has an inboard margin that, on installation, slides into said slot.

6. The masonry veneer support assembly of claim 1 wherein said second leg of said shelf angle has a tip most distant from the building structure and said soffit has an outboard flange folded to conceal said outboard tip.

7. The masonry veneer support assembly of claim 6 wherein said flange of said soffit has a return leg that extends rearwardly toward the building structure; and, as installed, masonry veneer seated above said second leg of said shelf angle overlaps at least a portion of said return leg.

8. The masonry veneer support assembly of claim 1 wherein said assembly includes a flashing drip edge that overhangs said soffit.

9. The masonry veneer support assembly of claim 1 wherein said soffit has an epoxy coating.

10. The masonry veneer support assembly of claim 1 wherein said horizontal leg of said shelf angle has a toe, and said outboard margin of said soffit has an accommodation sized to admit said toe of said shelf angle; and said assembly includes a support rail that mounts to a wall of structure, said support rail has a slot, and said soffit has an inboard margin that seat in said slot of said rail.

11. A soffit assembly comprising:

a first rail fitting that mounts to an inner wall;

a second rail fitting having a first engagement interface and a second engagement interface; and a soffit that extends between, and is mounted to, said first rail fitting and said second rail fitting said first engagement interface being mounted to a masonry veneer shelf angle; and said second engagement interface defining an accommodation in which to admit a margin of said soffit.

12. The soffit assembly of claim 11 wherein said first engagement fitting forms an interference fit with a toe of the masonry veneer shelf angle.

13. The soffit assembly of claim 11 wherein said first engagement fitting of said second rail fitting defines a socket in which to receive a toe of a shelf angle, and said second engagement fitting defining a first slot in which a first margin of the soffit is admitted on assembly.

14. The soffit assembly of claim 13 wherein said first rail fitting defines a second slot in which a second margin of said soffit is admitted on assembly.

15. The soffit assembly of claim 11 wherein said second rail fitting has a drip edge.

* * * * *